US010064535B2

(12) United States Patent
Azelton et al.

(10) Patent No.: US 10,064,535 B2
(45) Date of Patent: Sep. 4, 2018

(54) ALL-IN-ONE SCRUBBING TOOL WITH HOOK FOR SUBSTRATE ATTACHMENT

(71) Applicant: THE CLOROX COMPANY, Oakland, CA (US)

(72) Inventors: Kerry D. Azelton, Pleasanton, CA (US); John D. English, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 229 days.

(21) Appl. No.: 15/138,052

(22) Filed: Apr. 25, 2016

(65) Prior Publication Data

US 2016/0235272 A1 Aug. 18, 2016

Related U.S. Application Data

(63) Continuation-in-part of application No. 14/876,700, filed on Oct. 6, 2015.

(Continued)

(51) Int. Cl.
*B43K 5/02* (2006.01)
*A47L 13/17* (2006.01)

(Continued)

(52) U.S. Cl.
CPC ..... *A47L 13/17* (2013.01); *A47K 5/1201* (2013.01); *A47K 7/03* (2013.01); *A47L 13/16* (2013.01);

(Continued)

(58) Field of Classification Search
CPC ..... A47L 13/17

(Continued)

(56) References Cited

U.S. PATENT DOCUMENTS 41,700 A 2/1864 Hamilton et al.
D101,784 S 11/1936 Kurtz (Continued)

FOREIGN PATENT DOCUMENTS

CA 2491170 A2 6/2006
EP 0198389 B1 1/1995

(Continued)

OTHER PUBLICATIONS

NonFinal Office Action dated Dec. 30, 2016, U.S. Appl. No. 15/097,077, filed Apr. 12, 2016.

(Continued)

*Primary Examiner* — Jennifer C Chiang
(74) *Attorney, Agent, or Firm* — Alok Goel

(57) ABSTRACT

An all-in-one cleaning device, e.g., such as may be used in cleaning the inside of a shower. The device may provide the ability to dispense a cleaning composition carried within the device itself. The device may include a container housing including an internal reservoir for holding a cleaning composition, and a wall defining a scrubbing side of the container housing. The wall may include a dispensing orifice through which the cleaning composition is dispensed. A hook may be provided extending from the container housing, which is engageable with a substrate (e.g., a scrubbing pad) positioned over the wall defining the scrubbing side of the container housing. An end of the substrate may be held in place over the wall by the hook. Another end of the substrate may be held in place by a hook and loop attachment structure.

19 Claims, 13 Drawing Sheets

Related U.S. Application Data

(60) Provisional application No. 62/060,457, filed on Oct. 6, 2014.

(51) Int. Cl.
*C11D 17/04* (2006.01)
*A47K 5/12* (2006.01)
*A47K 7/03* (2006.01)
*A47L 13/16* (2006.01)

(52) U.S. Cl.
CPC ..... *C11D 17/041* (2013.01); *C11D 17/049* (2013.01)

(58) Field of Classification Search
USPC ..... 401/188 R
See application file for complete search history.

(56) References Cited

U.S. PATENT DOCUMENTS 2,557,267 A 6/1951 Ellinger
D301,204 S 5/1989 Cramer
4,850,729 A 7/1989 Kramer et al.
D321,930 S 11/1991 Dinand
D329,607 S 9/1992 Dinand
5,165,811 A 11/1992 MacLeod
D344,231 S 2/1994 Gagnon
5,454,659 A * 10/1995 Vosbikian ..... A47L 13/17 401/140
D373,955 S 9/1996 Boxer
5,656,226 A 8/1997 McVicker
D395,598 S 6/1998 Van Lit et al.
D398,427 S 9/1998 Berti
D409,915 S 5/1999 Durliat et al.
5,915,869 A 6/1999 Agosto et al.
D439,053 S 3/2001 Hay
6,224,283 B1 5/2001 Hay
D459,650 S 7/2002 Gagnon
6,425,701 B1 7/2002 Jacobs
D473,382 S 4/2003 Dutra
D477,917 S 8/2003 Giacolo et al.
6,685,376 B2 2/2004 Weihrauch
D496,202 S 9/2004 Hansen
D501,085 S 1/2005 Hay
6,842,936 B2 1/2005 Policicchio et al.
6,983,866 B2 1/2006 Smart
6,998,373 B1 2/2006 Faines, Jr. et al.
D524,546 S 7/2006 Ajluni et al.
7,131,902 B2 11/2006 Hope
7,264,414 B2 9/2007 McReynolds et al.
D556,408 S 11/2007 Lang et al.
D562,011 S 2/2008 Meyer
D564,353 S 3/2008 Ruiz De Gopegui et al.
D565,948 S 4/2008 Maas et al.
D569,723 S 5/2008 Sellick
D578,262 S 10/2008 Trotter et al.
D578,720 S 10/2008 Norcorn et al.
D580,274 S 11/2008 Abel
7,446,082 B2 11/2008 Kilkenny et al.
D583,156 S 12/2008 Constantine
D583,566 S 12/2008 Meyer
7,470,652 B2 12/2008 Kilkenny et al.
7,536,743 B2 5/2009 Goh et al.
7,540,056 B2 6/2009 Dotterman et al.
7,553,221 B2 6/2009 Hope et al.
D602,779 S 10/2009 Buogo et al.
7,610,647 B2 * 11/2009 Morgan ..... A47L 17/08 15/104.94
7,682,097 B2 3/2010 Knopow et al.
D617,198 S 6/2010 Lee et al.
7,837,403 B2 11/2010 Willinger
D628,481 S 12/2010 Maddy
D632,587 S 2/2011 Richmond
D636,860 S 4/2011 Abbondanzio et al.
D640,850 S 6/2011 Koenig et al.
8,025,453 B2 9/2011 Chan
D650,290 S 12/2011 Natsume et al.
D653,540 S 2/2012 Sweeton
D653,947 S 2/2012 Arminak
D655,199 S 3/2012 Ciriani
D656,413 S 3/2012 Hayton et al.
D658,063 S 4/2012 Simmons
8,167,510 B2 * 5/2012 LaFlamme ..... A45D 34/04 401/188 R
8,627,986 B2 1/2014 Bradbury
8,648,027 B2 2/2014 Mitchell et al.
8,684,619 B2 4/2014 Uchiyama et al.
D705,649 S 5/2014 Sweeton
8,763,616 B2 * 7/2014 Koptis ..... A46B 11/001 134/184
8,834,055 B2 9/2014 Uchiyama et al.
D714,648 S 10/2014 Kersten
D717,666 S 11/2014 Palm et al.
8,888,395 B1 11/2014 Hinnant
8,910,343 B2 * 12/2014 Huber ..... A47L 11/4086 15/320
D740,568 S 10/2015 Shafer et al.
D745,234 S 12/2015 Brown
D745,402 S 12/2015 Lovegrove
D764,309 S 8/2016 Yakos
D770,800 S 11/2016 Agarwal et al.
D805,391 S 12/2017 Azelton et al.
2003/0074756 A1 4/2003 Policicchio et al.
2003/0104962 A1 6/2003 Verherbrugghen et al.
2004/0101347 A1 * 5/2004 Beard ..... A47L 1/15 401/139
2004/0117935 A1 6/2004 Cavalheiro
2004/0140326 A1 7/2004 Smart et al.
2004/0265042 A1 12/2004 Chan et al.
2005/0039293 A1 2/2005 McReynolds et al.
2005/0069375 A1 3/2005 Kliegman
2005/0155628 A1 7/2005 Kilkenny et al.
2005/0155631 A1 7/2005 Kilkenny et al.
2005/0229344 A1 10/2005 Mittelstaedt et al.
2006/0032944 A1 2/2006 Hornsby et al.
2006/0048318 A1 3/2006 Goh et al.
2006/0048319 A1 3/2006 Morgan et al.
2006/0133886 A1 6/2006 Willinger
2006/0154582 A1 7/2006 Hope
2006/0168748 A1 8/2006 Dotterman et al.
2006/0168750 A1 8/2006 Dotterman et al.
2006/0233592 A1 10/2006 Knopow et al.
2007/0082591 A1 4/2007 Hope et al.
2007/0094827 A1 5/2007 Kilkenny
2007/0094829 A1 5/2007 Dotterman et al.
2007/0191252 A1 8/2007 Kilkenny et al.
2007/0191253 A1 8/2007 Kilkenny et al.
2008/0098546 A1 5/2008 Warmka et al.
2008/0115302 A1 5/2008 Kilkenny et al.
2008/0205965 A1 8/2008 LaFlamme
2008/0264972 A1 10/2008 LaFlamme
2008/0267689 A1 * 10/2008 Soller ..... A47L 1/15 401/264
2008/0317389 A1 12/2008 Pung et al.
2009/0038092 A1 2/2009 Kennedy et al.
2009/0165228 A1 7/2009 Kilkenny et al.
2011/0243643 A1 10/2011 Huang
2012/0096662 A1 4/2012 Uchiyama
2012/0301208 A1 * 11/2012 Hughes ..... A47L 13/12 401/137
2012/0301210 A1 11/2012 Sturgis et al.
2013/0043329 A1 2/2013 Bradbury
2013/0047358 A1 2/2013 Shafer et al.
2013/0047361 A1 2/2013 Meili et al.
2013/0047362 A1 2/2013 Steinhardt et al.
2013/0047363 A1 2/2013 Schafer et al.
2013/0340186 A1 12/2013 Uchiyama et al.
2014/0230847 A1 8/2014 Pung
2014/0259499 A1 9/2014 Post
2014/0259500 A1 9/2014 Post
2014/0259501 A1 9/2014 Post
2014/0265056 A1 9/2014 Kozak
2014/0290695 A1 10/2014 Uchiyama et al.
2015/0068371 A1 3/2015 Terrelonge

(56) References Cited

U.S. PATENT DOCUMENTS

| | | | | |
|---|---|---|---|---|
| 2015/0121637 | A1 | 5/2015 | Brenner | |
| 2015/0139721 | A1 | 5/2015 | Conway | |
| 2015/0297045 | A1 | 10/2015 | Marsh | |
| 2016/0096204 | A1 | 4/2016 | Perlas et al. | |
| 2016/0199162 | A1 | 7/2016 | Brilliant | |
| 2016/0220088 | A1 | 8/2016 | Zohar et al. | |
| 2016/0235272 | A1 | 8/2016 | Azelton et al. | |
| 2017/0172380 | A1* | 6/2017 | Sampaio | A47L 25/00 |

FOREIGN PATENT DOCUMENTS

| | | | |
|---|---|---|---|
| WO | 0162122 | A2 | 8/2001 |
| WO | 2004020151 | A1 | 3/2004 |
| WO | 2010032105 | A1 | 3/2010 |
| WO | 2014143415 | A1 | 9/2014 |

OTHER PUBLICATIONS

Notice of Allowance dated Dec. 7, 2017; U.S. Appl. No. 29/564,853, filed May 16, 2016.
Office Action dated Feb. 9, 2018; U.S. Appl. No. 14/876,700, filed Oct. 6, 2015.
Office Action dated Mar. 14, 2018; U.S. Appl. No. 15/097,077, filed Apr. 12, 2016.
Office Action dated Feb. 22, 2018; U.S. Appl. No. 29/564,854, filed May 16, 2016.

* cited by examiner

ALL-IN-ONE SCRUBBING TOOL WITH HOOK FOR SUBSTRATE ATTACHMENT

CROSS-REFERENCE TO RELATED APPLICATIONS

The present application is a continuation in part of U.S. patent application Ser. No. 14/876,700, filed Oct. 6, 2015 and entitled "ARTICLES FOR SCRUBBING AND CLEANING HARD SURFACES AND A METHOD FOR USE THEREOF", which claims the benefit of U.S. Patent Application Ser. No. 62/060,457, filed Oct. 6, 2014 and entitled "ARTICLE FOR SCRUBBING AND CLEANING HARD SURFACES AND A METHOD FOR USE THEREOF", the disclosure of each of which is incorporated by reference in its entirety.

BACKGROUND OF THE INVENTION

1. The Field of the Invention

The present invention relates to cleaning devices, particularly to devices for cleaning of hard surfaces, such as shower walls.

2. Description of Related Art

Nearly every consumer is familiar with the necessary but undesirable task of cleaning the shower or bathtub. Various devices and methods have been employed in cleaning showers, bathtubs, and other hard surfaces, although a continuing need exists for improved devices and methods.

BRIEF SUMMARY OF THE INVENTION

One aspect of the present invention relates to a cleaning device capable of dispensing a desired amount of cleaning composition (e.g., a liquid or gel) from a container housing onto a desired surface (e.g., tile, shower wall, bathtub, and the like). The container housing includes a reservoir into which the cleaning composition is loaded (e.g., prefilled during manufacture, or filled by a consumer). The container housing may also include a wall that defines a scrubbing side of the container housing, with a dispensing orifice through which the cleaning composition may be selectively dispensed. A substrate (e.g., configured as a scrubbing pad) may be provided over the scrubbing side of the container housing, to allow a user to scrub the cleaning composition onto or into a surface being cleaned (e.g., tile, shower wall, bathtub, mirror, or the like). The substrate may be one or more of a nonwoven, woven, foam, sponge, cellulose material, or other suitable material. The substrate material may be abrasive or soft depending on the cleaning application, or desired characteristics. In order to attach the substrate to the scrubbing side of the container housing, a hook may be provided extending from the container housing, which hook is engageable with the substrate (e.g., a slit formed therein) to assist in holding the substrate against the scrubbing side of the container housing and cleaning device.

In another embodiment, the cleaning device may include a container housing including a reservoir for holding a cleaning composition. The container housing may include a generally vertical wall (e.g., generally vertical when the cleaning device is upright) defining a scrubbing side of the container housing with a dispensing orifice through which the cleaning composition may be selectively dispensed. The container housing may further include a sidewall adjacent to the generally vertical wall which sidewall is a bottom wall when the cleaning device is oriented vertically upright. A hook extending from the bottom wall of the container housing may be provided, so as to be adjacent a bottom of the container housing. The hook may be engageable with a substrate configured as a scrubbing pad (e.g., a tab of the substrate) to assist in holding the substrate against the scrubbing side of the container housing. The substrate may be disposed over the wall defining the scrubbing side of the container housing, with the substrate disposed over or about the dispensing orifice so that when cleaning composition is dispensed (e.g., onto a desired surface such as tile, shower wall, bathtub, mirror, or the like), the substrate can be used to scrub the cleaning composition onto or into the surface that is to be cleaned.

As described, one end (e.g., a lower end) of the substrate may thus be held in place over the scrubbing side of the container housing by the hook extending from the bottom wall of the container housing. An opposite end (e.g., the top end of the substrate) may be held in place over the scrubbing side of the container housing by a hook portion of a hook and loop attachment structure, which hook portion may be integrally molded into the generally vertical wall of the container that defines the scrubbing side of the container housing. The hook portion of the hook and loop attachment structure may be positioned at an end of the container housing that is opposite the previously mentioned hook, so that the lower end of the substrate is attached to the container housing with the hook, and the top end of the substrate is attached to the container housing at the hook portion of the hook and loop attachment structure. For example, the hook portion may comprise a plurality of micro hook structures integrally molded with the wall of the container housing on which they are formed, which micro hook structures grab and engage the substrate. In other words, the substrate itself may serve as the loop portion of the hook and loop attachment structure.

Another embodiment of the cleaning device may include a container housing including a reservoir for holding a cleaning composition. The container housing may include a generally vertical wall (e.g., generally vertical when the cleaning device is upright) defining a scrubbing side of the container housing with a dispensing orifice through which the cleaning composition may be selectively dispensed. The container housing may further include a sidewall adjacent to the generally vertical wall which sidewall is a bottom wall when the cleaning device is oriented vertically upright. The cleaning device may further include an actuator at a top end of the container housing, and a pump assembly at least partially disposed within the container housing and in fluid communication with the cleaning composition within the reservoir. The actuator may be operably coupled to the pump assembly and configured to dispense a metered dose of the cleaning composition from the reservoir through the dispensing orifice upon actuation of the actuator. A hook extending from the bottom wall of the container housing may be provided, so as to be adjacent a bottom of the container housing. The hook may be engageable with a substrate configured as a scrubbing pad to assist in holding the substrate against the scrubbing side of the container housing. The substrate (e.g., nonwoven) may be disposed over the wall defining the scrubbing side of the container housing, with the substrate disposed over or about the dispensing orifice so that when cleaning composition is dispensed into the substrate or onto a desired surface such as tile, shower wall, bathtub, mirror, or the like, the substrate can be used to scrub the cleaning composition onto or into the surface that is to be cleaned.

One end (a lower end) of the substrate may thus be held in place over the scrubbing side of the container housing by the hook extending from the bottom wall of the container housing. An opposite end (e.g., the top end of the substrate) may be held in place over the scrubbing side of the container housing by a hook portion of a hook and loop attachment structure that is integrally molded into the generally vertical wall of the container that defines the scrubbing side of the container housing. The hook portion of the hook and loop attachment structure may be positioned at an end of the container housing that is opposite the previously mentioned hook, so that the lower end of the substrate is attached to the container housing with the hook, and the top end of the substrate is attached to the container housing at the hook portion of the hook and loop attachment structure.

Related methods of use may include providing a cleaning device such as described herein, dispensing a desired amount of the cleaning composition onto a surface to be cleaned (or into the substrate of the cleaning device), and using the substrate to scrub the cleaning composition onto or into the surface being cleaned. In an embodiment, the user may wait a requisite time between dispensing the composition onto the surface to be cleaned, (e.g., for disinfection or other cleaning activity provided by the cleaning composition to occur) and scrubbing the cleaning composition onto or into the surface being cleaned. In another embodiment, the user may wait a requisite time between scrubbing the cleaning composition onto or into the surface being cleaned, and rinsing the surface (e.g., with water). In another embodiment, the user may not rinse the cleaning composition from the surface being cleaned, but may allow it to remain on the surface. Where a waiting period occurs, it may be from about 5 seconds to about 5 minutes, from about 5 seconds to about 3 minutes, from about 5 seconds to about 2 minutes, or from about 5 seconds to about 1 minute.

Such methods may be used immediately before, immediately after, or during showering, using the cleaning device to dispense the cleaning composition and to clean the shower. This may be done in the flow of the shower water, if desired.

Other embodiments of cleaning devices are also described herein. In an embodiment, the cleaning device includes a container housing including a reservoir for holding a cleaning composition, an actuator disposed at a top end of the container housing, a pump assembly at least partially disposed within the container housing and in fluid communication with the cleaning composition within the reservoir. The actuator may be operably coupled to the pump assembly and may be configured to dispense a metered dose of the cleaning composition from the reservoir through a dispensing orifice, into the substrate. The substrate may be attached to a scrubbing surface (also referred to herein as a scrubbing side) of the container housing, the substrate being disposed over or about the dispensing orifice so that upon actuation of the actuator (e.g., a button), the cleaning composition is dispensed from the reservoir, through the dispensing orifice, and into the substrate.

In an embodiment, the cleaning device includes a container housing including a reservoir for holding a cleaning composition, an actuator that may be disposed at a top end of the container housing, configured to be actuated by a finger (e.g., index finger) of a user as the user grips the container housing. A pump assembly may be at least partially disposed within the container housing and be in fluid communication with the cleaning composition within the reservoir. The actuator may be operably coupled to the pump assembly and configured to dispense a metered dose of the cleaning composition from the reservoir through a dispensing orifice into a substrate upon actuation of the actuator by the user. The substrate may be provided attached to a generally vertical scrubbing side of the container housing when the container housing is oriented upright, against a shower wall or other vertical hard surface to be cleaned. The substrate may be disposed over or about the dispensing orifice, and the dispensing orifice may be oriented generally horizontally relative to the generally vertical scrubbing surface when the container housing is oriented upright, against the shower wall or other vertical hard surface to be cleaned. Upon actuation of the actuator, the cleaning composition may be dispensed from the reservoir, through the dispensing orifice, and into the substrate.

The device advantageously may provide for a metered dose of the cleaning composition, sprayed onto or into the substrate (e.g., a nonwoven), with the dispensing orifice and associated delivery channel in a generally horizontal orientation. Often, existing dispensing systems have difficulty dispensing a composition when the delivery channel and dispensing orifice is generally horizontal, as provided herein. The device may be employed for dispensing the cleaning composition in a variety of orientations and/or angles, e.g., as would exist when pressing the substrate on the scrubbing surface against a shower wall, a bathtub, a shower shelf, shower or bathtub floor, ceiling, etc. Thus, no matter the orientation of the device, the delivery channel and the dispensing orifice, actuation of the actuator may be effective to cause dispensing of the desired metered, unit dose of the cleaning composition to the substrate, where it can then be scrubbed against the surface to be cleaned. The system may advantageously be sealed, so as to prevent contamination of the cleaning composition as might otherwise occur through backflow of cleaning composition and/or water (e.g., shower water) back into the reservoir. This may be of particular benefit where the device is used while the user is showering, in the flow of the shower water. For example, the pump assembly may include a one-way valve to prevent such backflow.

The device may further be configured for use and prolonged storage within a relatively high humidity environment (e.g., in the shower), without degradation of any adhesive between the substrate and the scrubbing side of the container housing. For example, many adhesives are not compatible with prolonged storage and use in such high humidity environments, which would lead to unwanted separation between the substrate and the surface of the container housing to which the substrate is attached.

Another embodiment of the present invention is directed to a method of cleaning a shower. Such a method may include providing a cleaning device such as that described herein, and using the cleaning device to dispense the cleaning composition and clean the shower. Such cleaning (e.g., scrubbing of shower walls, shelves, floors, ceiling, etc.) may be performed immediately before, immediately after, or while the user showers (e.g., cleaning the shower in the flow of the shower water). The cleaning composition may be skin safe so as to not irritate the skin of the user to better facilitate such use.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1:
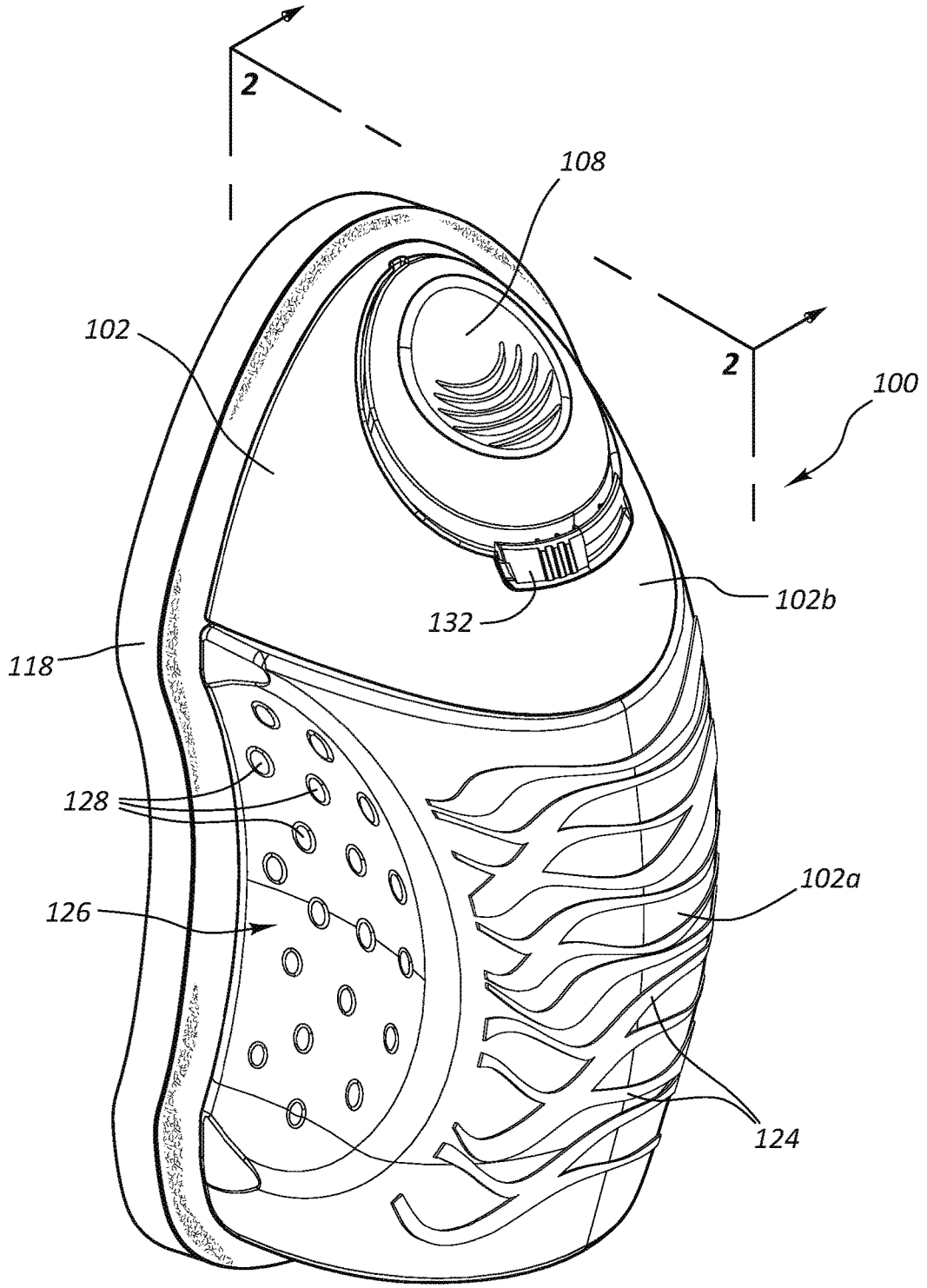
FIG. 1 is a perspective view of an exemplary cleaning device.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

As used herein, directional terms, including, but not limited to, "top", "bottom", "left", "right", "up", "down", "upper", "lower", "proximal", "distal" and the like where used herein are solely to indicate relative directions and are not otherwise intended to limit the scope of the disclosure and/or claimed invention (e.g., if the cleaning device were turned upside down, "top" may become "bottom", etc.).

Unless otherwise stated, all percentages, ratios, parts, and amounts used and described herein are by weight.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 25%, within 20%, within 10%, within 5%, within 1%, etc. of a stated value. Furthermore, the terms "substantially", "similarly", "about" or "approximately" as used herein represent an amount or state close to the stated amount or state that still performs a desired function or achieves a desired result. For example, the term "substantially" "about" or "approximately" may refer to an amount that is within 25%, within 20%, within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition.

As used herein, the term "substrate" is intended to include any material that is used to clean an article or a surface. Examples of cleaning substrates include, but are not limited to nonwovens, sponges, wovens, and similar materials which can be attached to the cleaning device.

As used herein, the terms "nonwoven" or "nonwoven web" means a web having a structure of individual fibers or threads which are interlaid, but not in an identifiable manner as in a knitted web. Nonwoven webs may be formed from many processes, such as, for example, meltblowing, spunbonding, needle punching and bonded carded web processes.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

In an aspect, the present invention is directed to an all-in-one cleaning device, e.g., such as may be used in cleaning the inside of a shower. The device may provide the ability to dispense a cleaning composition carried within the device itself, and scrub the composition into or against the surfaces to be cleaned (e.g., shower walls, bathtub, shower shelves, floors, corners, ceilings, etc.).

In an embodiment, the cleaning device may include a substrate (e.g., configured as a scrubbing pad) which may be attached to a wall of the container housing which wall defines a scrubbing side of the container housing. The substrate may be attached by a hook at one end (e.g., at a lower end) and a hook and loop attachment structure at another end (e.g., a top end). The hook which attaches the lower end of the substrate may extend from the container housing, e.g., it may be injection molded with the container housing, all as a single piece. In an embodiment, the hook may be configured as a fish hook or a barb. The hook may extend from a wall of the container housing, which wall is a bottom wall when the cleaning device is oriented upright. The hook may be positioned at a parting line of the container housing (where the mold halves of the injection mold separate, and flashing is formed). For example, the hook may be positioned on such a parting line, in a flash pocket of the injection molded container housing. While other methods of manufacture may also be possible, injection molding of the container housing (and hook) may be particularly effective for mass manufacture.

Other embodiments of the cleaning devices which may not necessarily include such a hook are also described herein. For example, the cleaning devices may include an actuator and pump assembly or other dispensing mechanism on or within the container housing. For example, activation of a dispensing mechanism (e.g., an actuator and a pump assembly) of the cleaning device may dispense a metered dose (e.g., about 0.6 cc) of composition, in a generally horizontal direction, into a nonwoven substrate. The dispensing mechanism may not rely on gravity (i.e., not gravity fed) for dispensing, and may be sealed to prevent leaking and/or unwanted backflow of shower water or other material, preventing contamination.

The cleaning device may include a container housing including a reservoir for holding a cleaning composition, an actuator, e.g., disposed at a top end of the container housing, a pump assembly at least partially disposed within the container housing and in fluid communication with the cleaning composition within the reservoir. The actuator may be operably coupled to the pump assembly and configured to dispense a metered dose of the cleaning composition from the reservoir through a dispensing orifice, onto or into a substrate. The substrate may be attached to a scrubbing surface of the container housing. The substrate may be disposed over or about the dispensing orifice so that upon actuation of the actuator, the cleaning composition is dispensed from the reservoir, through the dispensing orifice, to the substrate.

According to another aspect, the present invention provides a method of using any of the cleaning devices disclosed herein. For example, the cleaning device may be used to clean the shower immediately before, immediately after, or while the user is showering (e.g., cleaning in the flow of the shower water). Such a method may include providing a cleaning device as described herein, and immediately before, immediately after, or during showering, using the cleaning device to dispense the cleaning composition and to clean the shower. As mentioned, this may be done in the flow of the shower water. The cleaning composition may be formulated so as to be skin safe so as to not irritate the skin of the user as the user cleans the shower in the flow of the shower water.

This cleaning device can be used on kitchen surfaces, which may include, but may not limited to, multi-purpose, countertop, sinks, drains, faucets, fixtures, tables, stove top, range hood, ovens (inside and outside), microwave, small appliances, refrigerator, cutting boards, cabinets, trash cans, walls and surrounding areas. This cleaning device can also be used in the bathroom, which may include, but may not limited to, countertop, sinks, drains, faucets, fixtures, mirrors, cabinets, trash cans, toilet, toilet seat, shower, floor, shower door, curtains, walls and surrounding areas. This cleaning device may be used around the home, which may include, but not limited to, floor, carpet, BBQ grill, oven rack, outdoor furniture, and soft surfaces such as on fabrics.

III. Exemplary Cleaning Devices

Embodiments of cleaning devices including a substrate that may be attached without a hook will be described first, followed by a description of cleaning devices including a hook for attachment of the substrate to the container housing. It will be appreciated that features described in the context of one type of embodiment may be incorporated within the other type of embodiment, and vice versa.

Figure 2:
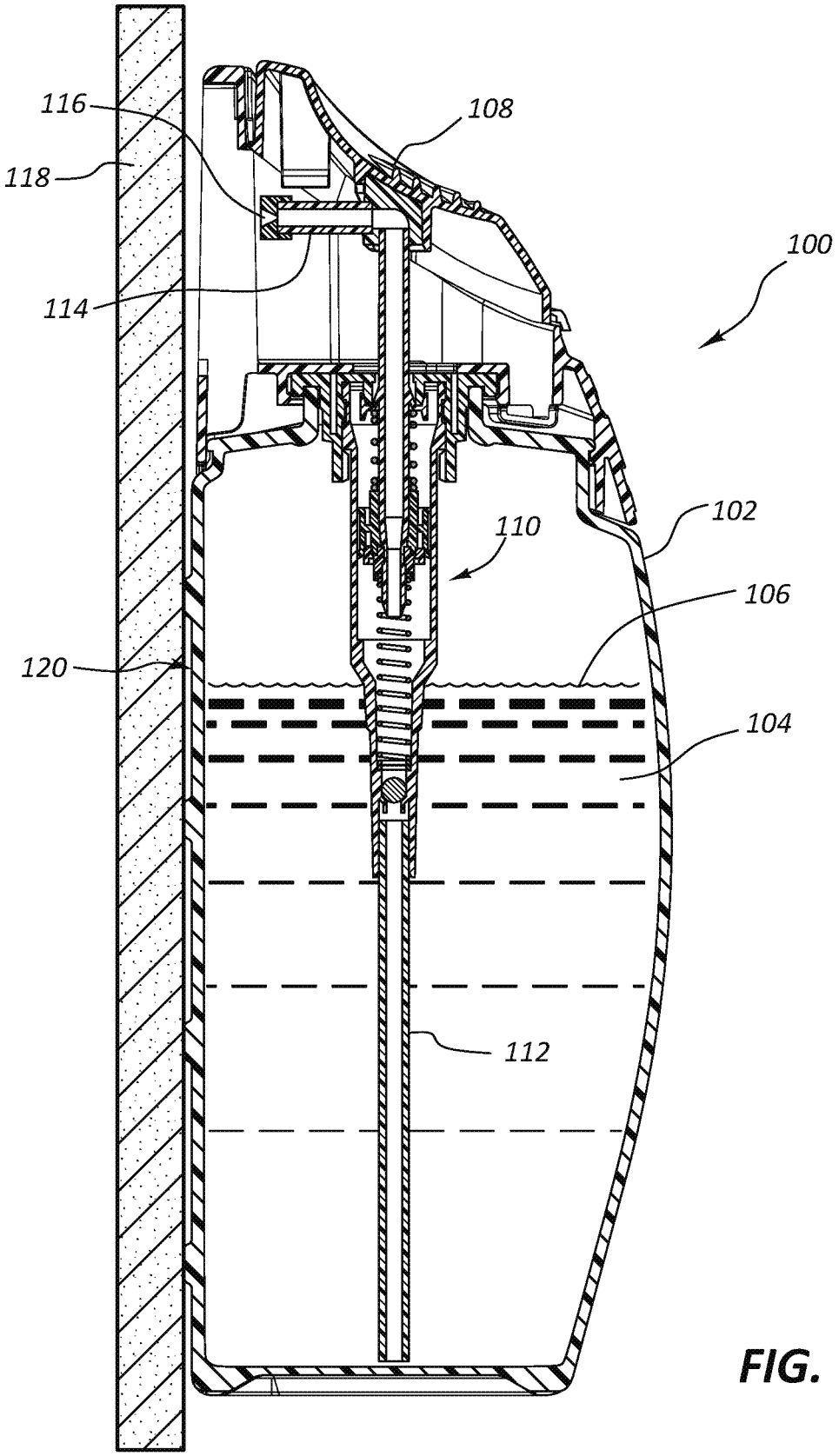
FIG. 2 is a cross-sectional view through the cleaning device of FIG. 1.
Figure 3:
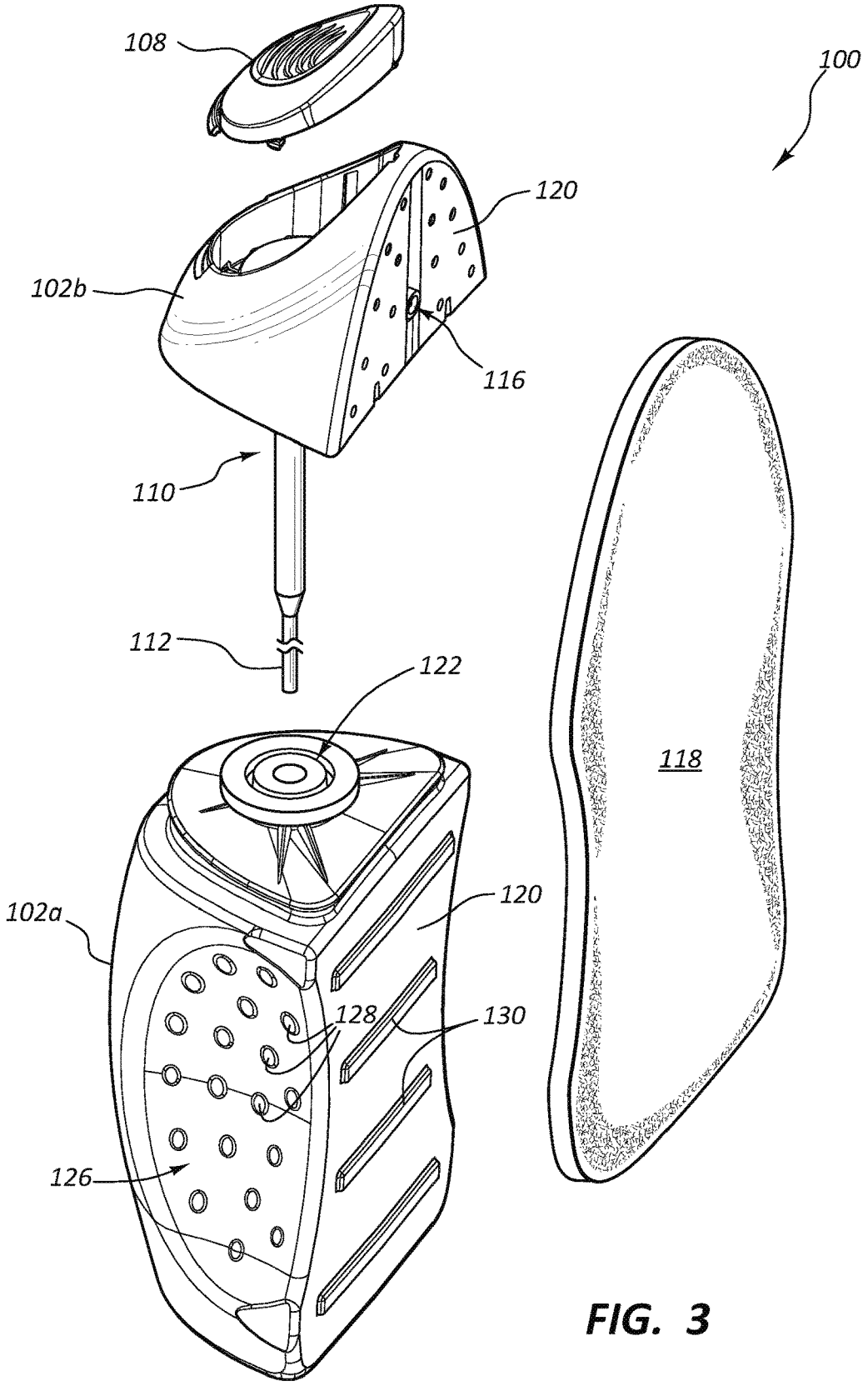
FIG. 3 is an exploded view of the cleaning device of FIG. 1.
Figure 4A:
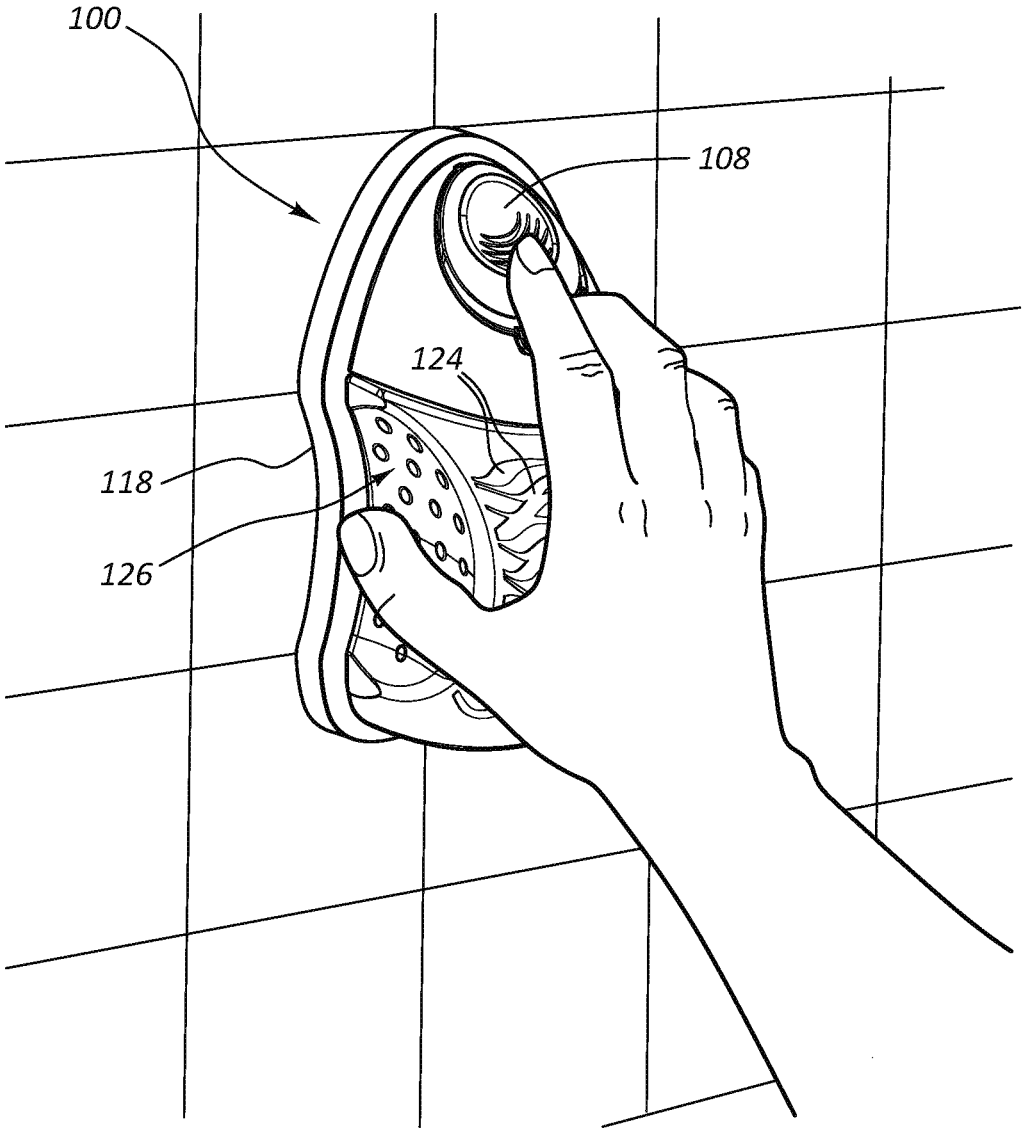
FIGS. 4A-4B show a user using the device to scrub a shower wall.

FIGS. 1-3 show an exemplary cleaning device 100 including a container housing 102 which includes a reservoir 104 for holding a cleaning composition 106. Composition 106 may be preloaded within the reservoir 104 of container housing 102, e.g., during manufacture. Cleaning device 100 may further include an actuator 108 (e.g., a button). Actuator 108 is shown as disposed at a top end of device 100, while container housing 102 is particularly shaped to provide for easy single-handed gripping of housing 102, e.g., between a thumb and fingers of a user's hand (see FIG. 4A). Positioning of actuator 108 at a top end of device 100 facilitates pressing or other actuation of actuator 108 by the user's index finger, as shown in FIG. 4A, to dispense the cleaning composition 106.

As perhaps best seen in the cross-sectional view of FIG. 2, a pump assembly 110 may be provided at least partially disposed within container housing 102, in fluid communication with cleaning composition 106. Button or other actuator 108 may be operably coupled to pump assembly 110, so as to be configured to dispense a metered dose (e.g., a calibrated amount) of the cleaning composition 106 upon pressing or otherwise actuating actuator 108. Upon pressing actuator 108, e.g., a suction force may be generated, forcing the metered amount of composition 106 up from reservoir 104, through dip tube 112, up through delivery channel 114, to dispensing orifice 116. At dispensing orifice 116, composition 106 may be sprayed or otherwise dispensed into substrate 118. As seen in FIG. 1, a lock 132 or tab other suitable mechanism may be provided to prevent inadvertent actuation of (e.g. during shipment, storage, etc.) of actuator 108.

Substrate 118 may be attached to scrubbing surface 120 of container housing 102. As seen in FIG. 2, substrate 118 may be disposed over, or about the dispensing orifice 116, so that upon actuation of actuator 108, cleaning composition 106 is dispensed from reservoir 104 through orifice 116, and into substrate 118. In an embodiment, the substrate 118 may include one or more holes through which the composition 106 is dispensed. In another embodiment, it may cover the orifice 116, so as to be dispensed directly into the substrate. Substrate 118 may comprise any suitable material that can be used to scrub and clean the surface (e.g., a shower wall, bathtub, etc.) against which it is pressed and scrubbed (e.g., moved in generally circular motions, moved up and down, or side to side, while pressing the device and substrate 118 against the surface being cleaned).

In an embodiment, substrate 118 may be nonwoven. In another embodiment it may be a foam pad, an abrasive pad, bristles, sponge, a woven material, or otherwise configured. Use of a nonwoven may aid in developing as the substrate with cleaning composition therein is scrubbed into the desired surface. In an embodiment, the substrate may be a relatively high loft material that is easily compressed when pressure is applied during the cleaning process. The high loft material may be designed to help mechanically generate foam in the cleaning composition as it is dispensed through the substrate. The substrate 118 may be absorbent, or non-absorbent (e.g., a synthetic non-absorbent). Substrate 118 may be sufficiently durable so as to be used for several uses. For example, the cleaning device 100 may be configured as an all-in one cleaning tool, prefilled with a desired amount of cleaning composition, e.g., sufficient for at least about 10, at least about 20, not more than about 50, or not more than about 40 shower cleanings (e.g., about 30 cleanings).

As shown in FIG. 1, substrate 118 may be oversized relative to the scrubbing surface 120 of container housing 102. In other words, substrate 118 may extend beyond the outer perimeter of housing 102. Such a configuration increases the surface area associated with substrate 118 for scrubbing, and also facilitates easier reach of substrate 118 into corners, particularly with the rounded or pointed top of the substrate 118 and housing 102 seen in FIG. 1.

In an embodiment, the substrate and/or cleaning composition 106 may include an antimicrobial agent therein. For example, the substrate 118 may include silver ions provided therein. An exemplary substrate may be a polyethylene terephthalate (PET) fiber blend (e.g., including various denier fibers). Suitable substrates are available from Filtrair (Heerenveen, Netherlands). In one embodiment the substrate may include a binder to adhere one or more substrate materials and/or layers together. The binder may have antimicrobial properties that aid in keeping the substrate free from bacteria or microbes between uses. Suitable examples of other antimicrobials which may be used on the nonwoven substrate, with or without a binder, include but are not limited to: SPOR-AX Antimicrobial agent provided by Fiberbond Corporation (Michigan City, Ind.) and AEGIS antimicrobial from the AEGIS Microbe Shield Technology provided by Microban International (Huntersville, N.C.) and quaternary ammonium compounds such as, 3-trimethoxy silyl propyl dimethyl octadecyl ammonium chloride. In another embodiment of the invention, the substrate materials utilize capillary and/or wicking properties to efficiently distribute the cleaning composition throughout the substrate after it is sprayed.

As shown in FIG. 2, the scrubbing surface 120 of housing 102 may include ribs or protrusions 130, or other texturing (e.g., roughened texture) on an underside thereof in order to improve bonding of substrate 118 to the scrubbing surface 120. Other than such ribs or protrusions 130, scrubbing surface 120 may be generally planar (e.g., flat). Substrate 118 may be secured to surface 120 by mechanical mechanisms (e.g., interlock between surface 120 and substrate 118), use of an adhesive, or combinations thereof. Although in an embodiment, the substrate 118 may be permanently, non-removably attached to surface 120, in another embodiment, it may be detachable (e.g., to permit replacement). Suitable attachment structures include but are not limited to: an adhesive between the substrate and the housing, a slide-on or snap-fit bracket attaching to the housing wherein the bracket attaches to substrate, a hook and loop attachment structure between the substrate and the housing, and any other suitable attachment structures. In one embodiment, the housing comprises high density polyethylene (HDPE) and soft touch which aids in allowing an adhesive to bond between the housing and the substrate material. The addition of the soft touch to the HDPE material allows the adhesive to retain the substrate in a fixed arrangement through many uses and with vigorous scrubbing.

In an embodiment, the substrate may include two or more differently configured portions. For example, bristles, or other substrate disposed at a top portion of the cleaning device may be stiffer and/or more abrasive as compared to other portions of the substrate, for use in better cleaning corners, grout lines between tiles, etc.

Figure 5A:
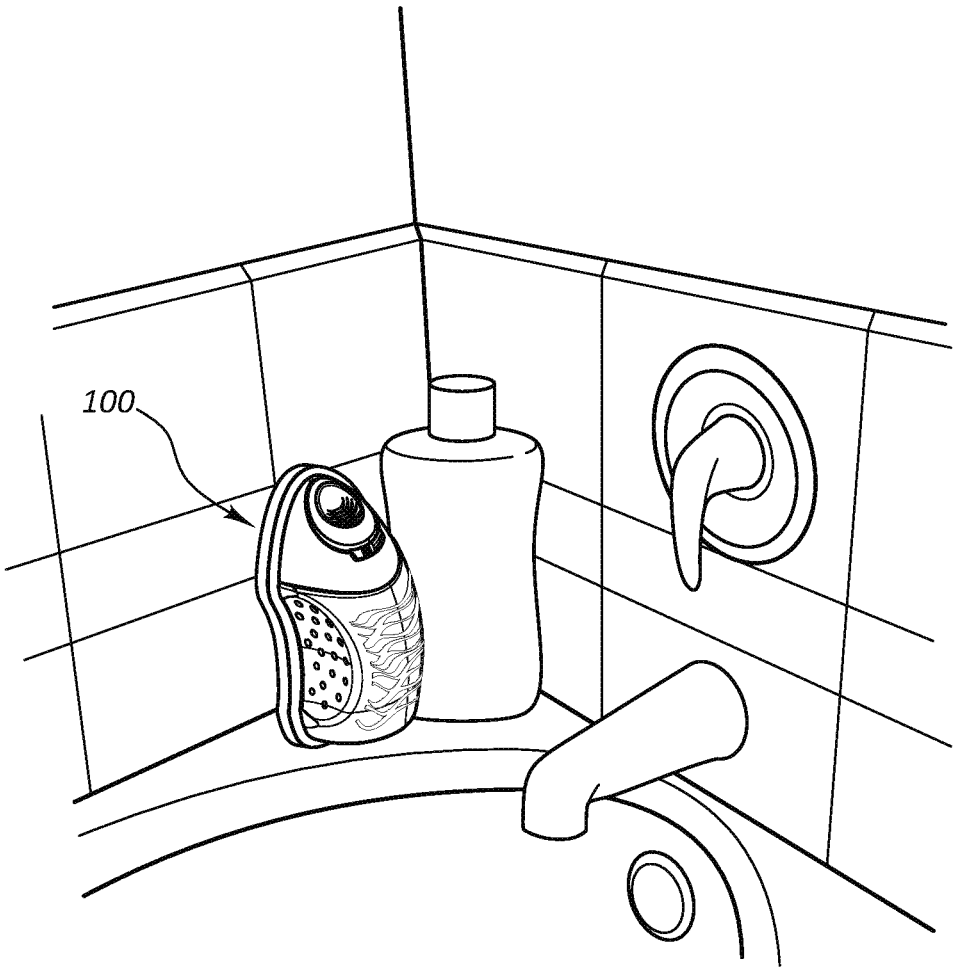
FIGS. 5A-5B shows how the device may be stored between uses in the shower and/or bathtub.
Figure 5B:
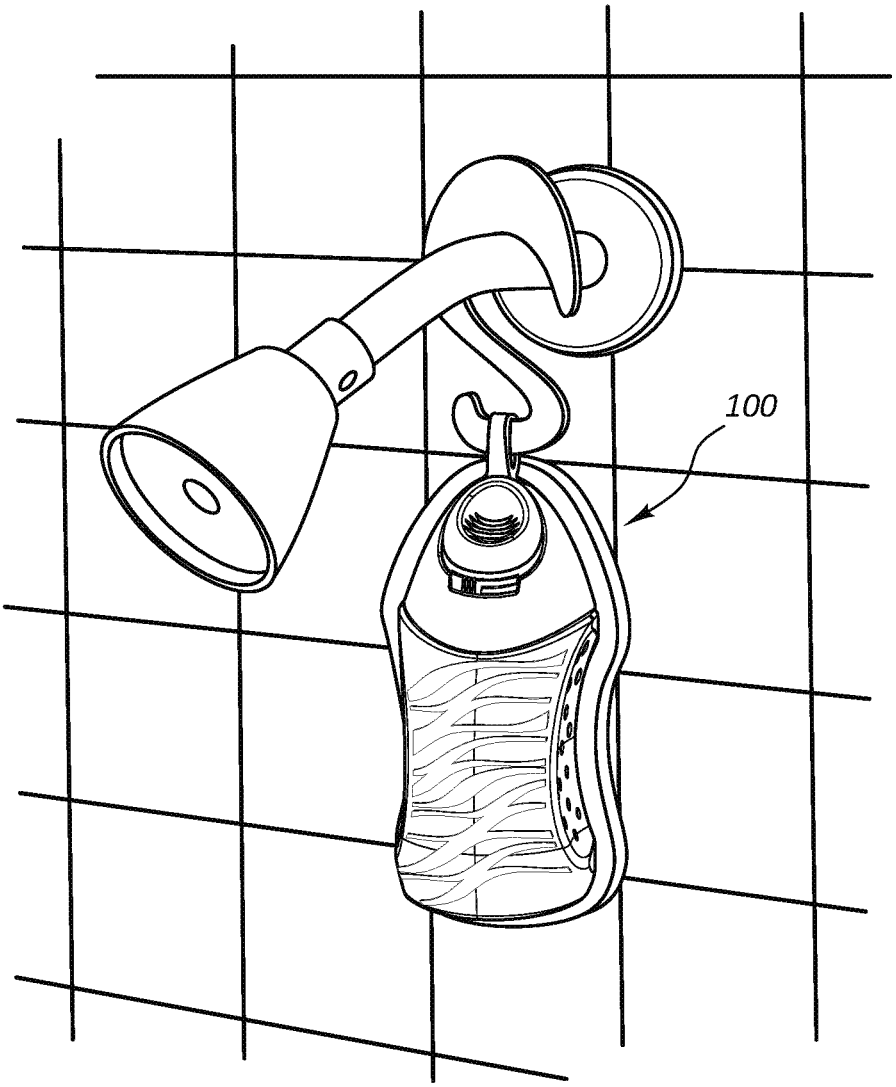

The cleaning device may be stored in the shower, as described herein and shown in FIGS. 5A-5B. In such conditions, the device, including substrate 118 and any adhesive attaching substrate 118 to surface 120 is regularly subjected to a high humidity environment. In addition, the substrate and the remainder of device 100 may often be contacted with water (e.g., flowing shower water, etc.). Many adhesives will not tolerate such conditions, but tend to peel and separate between the surfaces meant to be joined together when subjected to such conditions for an extended period. The present inventors have found that when using polyolefin-based glues with a synthetic polymer backbone of polyethylene as an adhesive, the adhesive is able to mimic the plastic it is bonding to and it minimizes any separation problems between the plastic and adhesive under high humidity use and storage. Suitable adhesives include, but are not limited to, hot melt adhesives, polyolefin-based glues with a synthetic polymer backbone of polyethylene, rubber-based glues with a styrene-butadiene polymer backbone, and any combinations or mixtures thereof. Suitable adhesive materials, such as TECHNOMELT DM 800B DIPSOMELT and TECHNOMELT DM 106C DIPSOMELT, materials are available from the Henkel Corporation (Düsseldorf, Germany).

Pump assembly 110 may be configured to work in a manner that does not rely on gravity feed of the cleaning composition towards the dispensing orifice 116, as do various existing cleaning devices. Rather, the pump assembly may rely on generation of a suction force upon pressing or other activation of actuator 108, to draw composition 106 into dip tube 112. In one embodiment, the dip tube may be provided at an angle or curved so that in a horizontal orientation, as shown in FIG. 2, the bottom opening dip tube 112 would be closer to surface 120 than the center of the container housing 102. The particular pump mechanism employed in assembly 110 may advantageously be particularly configured so as to reliably operate no matter the orientation of the device, or the orientation of the pump assembly. For example, many existing pump assembly configurations perform poorly, if at all, in so far as effective and accurate dispensing of the desired dose of composition, when the dispensing orifice or delivery channel adjacent thereto is oriented generally horizontally.

As seen in FIG. 2, the delivery channel 114 and orifice 116 are generally horizontal, in order to deliver the cleaning composition 106 into generally vertical substrate 118 (e.g., as it is pressed against a vertical shower wall). FIG. 4A illustrates such use, where the device may typically be oriented vertically, parallel to a shower wall or similar structure being scrubbed. In such an orientation, and even when device 100 is rotated clockwise or counterclockwise 90° (e.g., oriented sideways, 45° degree angle, etc.) in either direction or at any angle in between 0°-90° and 270°-360° the device will continue to reliably dispense the cleaning composition. Such changes in orientation (any any orientations therebetween) may be common as a user scrubs up and down, and side to side over a shower wall, bathtub, or similar surface.

Pump assemblies having such desirable operation characteristics are available from various manufacturers. For example, Guala Dispensing (Mt. Pleasant, S.C.) manufactures pump assemblies that may be suitable for use, in conjunction with the actuator 108, delivery channel 114, and orifice 116. Various other pump assemblies providing similar operational characteristics may also be suitable for use.

FIG. 3 shows an exploded view of cleaning device 100, showing a configuration in which the container housing 102 may be provided in two parts, e.g., a lower housing portion 102*a* that includes reservoir 104, and an upper shroud portion 102*b* that may couple to pump assembly 110, and into which actuator 108 may be coupled. As shown, lower housing portion 102*a* may include a hole 122 into which dip tube 112 of pump assembly 110 may be received. Any of various suitable mechanisms may be employed to attach portions 102*b* and 102*a* together, e.g., a bayonet coupling, a snap fit, a screw-on connection, welded connection, use of an adhesive, combinations thereof, etc. A seal may be provided at any such attachment location between housing portion 102*a* and shroud 102*b*, particularly a seal between pump assembly 110 and housing portion 102*a*. Examples of such seals may include, but are not limited to a plug seal, a rib seal, a crab claw seal, a friction seal, combinations thereof, etc. One of skill in the art, in light of the present disclosure, will appreciate various specific configurations that may be employed.

In an embodiment a tight (e.g., air-tight, and/or water-tight) seal may be provided relative to pump assembly 110 and reservoir 104, so as to prevent contamination, backflow, or other issues resulting from undesirable contact or flow between such structures. For example, where the cleaning device 100 is used to clean a shower wall, bathtub or similar surface in the flow of shower water, in bathwater, or even submerged in a bathtub, advantageously the device may prevent such water present from backflowing into the reservoir (e.g., through orifice 116, channel 114, and diptube 112). Prevention of such backflow may be advantageous, particularly where the device 100 is used in such environments where shower water, bath water, etc. may contact the exterior surfaces of the cleaning device. In addition to a seal between assembly 110 and reservoir 104, any valve included in the pump assembly 110 for dispensing the composition may be a one-way valve, so as to prevent backflow.

In an embodiment, the lower housing portion 102*a* including reservoir 104 may be blow molded, injection molded, or otherwise formed from a suitable plastic material. The shroud portion 102*b* may be formed from similar or other suitable manufacturing techniques from a suitable plastic material (e.g., polypropylene, polyethylene, other polyolefins, etc.).

In an embodiment, the lower housing portion 102*a* (e.g., that portion typically gripped by the user) may include an elastomeric grippable portion 124 or material (e.g., over-molded) or otherwise provided over housing portion 102*a*. In an embodiment, such a portion 124 may be provided by an Adflex TPO (thermoplastic polyolefin) which creates soft touch coating. Suitable soft touch coatings may comprise an ethylene-propylene copolymer, 1-propene-ethylene copolymer, or combinations thereof. Various other suitable providers of such grippable, soft touch coatings or materials will be apparent to one of skill in the art. Adflex TPO materials, such as Adflex Q 302 B, soft touch coating materials are available from Lyondellbassell (Houston, Tex.). In one embodiment of the invention, the soft touch material is blended with the HDPE so that the soft touch material is about 5-30% by weight, or about 5-20% by weight or about 5-15% by weight of the soft touch/HDPE blend.

Such grippable portion 124 may include a decorative or other pattern (e.g., raised, embossed, etc.) provided therein. Such grippable portion may aid the user in retaining a good grip on the cleaning device 100, particularly in the contemplated environment, where it may be quite wet. As shown, the sides of housing portion 102*a* may include concavely curved portions 126 on opposite sides, to better facilitate gripping, e.g., between a thumb and finger(s) of a single hand. Such concave portions 126 may further include bumps or protrusions 128 to further improve grip of the device within the hand of a user. The top region of housing portion 102*a* may be convexly curved, to ergonomically fit within the palm portion of the user's hand. The result of such features for improved grip are readily seen in FIG. 4A.

As seen in FIGS. 4A-4B and FIG. 5A-5B, the device 100 may typically be vertically oriented, at least for a portion of the time during cleaning, and also during storage. Such a generally vertical orientation during storage allows the substrate to dry under influence of gravity, as water drains from the substrate downwards, towards the bottom of the device. Such a vertical standing orientation allows the substrate to dry in between uses. In this embodiment, the bottom of the device is flat so that it may easily stand and not tip over in a vertical storage orientation which allows the substrate to dry between uses. Such drying is further aided by the sealed characteristics of the lower container housing portion 102*a*, and the metered dose characteristics, which aid in preventing leakage of composition 106 during storage.

The cleaning composition may typically be an aqueous composition including a surfactant, and water. Various other components may also be present. An organic or mineral acid (e.g., to aid in cleaning) may be included. One or more of a chelating agent, an oxidizing agent (e.g., any peroxide, such as hydrogen peroxide, or a hypochlorite, (e.g., sodium hypochlorite), or hypochlorous acid, or combinations thereof), or one or more other adjuncts selected from the group consisting of fragrances, dyes, preservatives, humectants, solvents, polymers, pH adjusters, solubilizers, and combinations thereof may also be provided.

The composition may have a viscosity so that it may readily be dispensed as described herein. Liquid compositions may have a viscosity of less than 10,000 cps, or less than 1,000 cps. Gel compositions may also be suitable for dispensing as described herein, and may have relatively higher viscosities.

In one embodiment, the composition may have a pH from about 4 to about 8 (about 4, about 5, about 6, about 7, or about 8, or any range defined between any such values). The composition may limit the surfactant concentration to below about 5% by weight. The pH, surfactant concentration, surfactant type, and concentration and/or presence of other components may be specifically configured to ensure that the composition is skin safe so as to not irritate the skin of a user as the user cleans the shower, e.g., even in the flow of the shower water.

Under such conditions, it will be apparent that contact of the cleaning composition with the user's skin is likely to occur. In an embodiment, the composition may be formulated to not irritate the eyes, should the composition get splashed into, or otherwise contact the eye(s) of the user. Such skin safety or eye safety characteristics may be determined by any suitable test, such as by a standard repeat insult patch test (RIPT) test. In an embodiment, the cleaning composition will pass an in vitro dermal irritancy test. In an embodiment, the cleaning composition will pass an in vitro eye irritancy test. In an embodiment, the cleaning composition will pass both an in vitro dermal irritancy test and an in vitro eye irritancy test. Suitable OECD in vitro test methods include but are not limited to: 431 skin corrosion; 430 skin corrosion; 437 BCOP Bovine Corneal Opacity and Permeability; 439 skin irritation, and other tests for skin or eye irritation.

In an alternative embodiment, the composition contains a hypochlorite component and the pH range is between 8 and 14, preferably between 9 and 13, more preferably between 10 and 13. In the embodiment of the invention that contains hypochlorite, the composition in the cleaning device is designed so that the user may dose the substrate directly which minimizes skin contact and any overspray that a user would normally experience with a traditional cleaning tool or sprayer.

In one embodiment, the cleaning composition may include one or more surfactants. Examples include, but are not limited to sulfates, sulfonates, betaines, alkyl polysaccharides, (e.g., alkyl polyglycosides, also known as alkyl polyglucosides), amine oxides, tweens, alcohol ethoxylates, and combinations thereof. One or more of the selected surfactants may provide foam building characteristics. The surfactant concentration may be less than 5% by weight, less than 4%, less than 3%, or less than 2% by weight (e.g., 1% to 2% by weight).

The surfactant(s) may include nonionic, anionic, cationic, ampholytic, amphoteric, zwitterionic surfactants, and mixtures thereof. A typical listing of anionic, ampholytic, and zwitterionic classes, and species of these surfactants, is given in U.S. Pat. No. 3,929,678 to Laughlin. A list of cationic surfactants is given in U.S. Pat. No. 4,259,217 to Murphy. Various alkyl polysaccharide surfactants are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al. U.S. Pat. No. 4,565,647 to Llenado. Various nonionic surfactants can be found in U.S. Pat. No. 3,929,678 to Laughlin. Each of the above patents is incorporated by reference.

An organic acid (e.g., citric acid), or relatively weaker mineral acid (e.g., phosphoric acid) may be included for cleaning. Where included, such an acid may be included in an amount of less than 5%, less than 4%, less than 3%, less than 2% (e.g., from 1% to 2%, or from greater than 0.5% to about 1.5%).

Exemplary organic acid may include 2-hydroxycarboxylic acids or mixtures of two or more acids. Examples of such acids include, but are not limited to, tartaric acid, citric acid, malic acid, mandelic acid, oxalic acid, glycolic acid, lactic acid, and acetic acid. Citric acid, lactic acid, or mixtures thereof may exhibit an antimicrobial effect.

pH adjusters (e.g., sodium hydroxide, or another hydroxide), if present, may typically be included in an amount of less than 3%, less than 2%, less than 1% (e.g., from about 0.5% or greater than 0.5% to 1%). For adjusting pH downward, any of the above described acids may also be suitable for use.

Solubilizers (e.g., to solubilize a fragrance or other oil), if present, may typically be included in an amount of less than 1%, less than 0.5%, less than 0.3% (e.g., from about 0.01% to 0.5%).

Dyes, fragrances, and/or preservatives, if present, may typically be included in an amount of less than 1%, or less than 0.5%. Any other components (e.g., oxidizers, or others mentioned herein) may be present in amounts of less than 10%, less than 5%, less than 4%, less than 3%, less than 2%, less than 1%, or less than 0.5%

Exemplary cleaning composition formulations are shown in Tables 1-3 below, with the balance being water.

TABLE 1

| Component | Function | Weight Percent Active |
|---|---|---|
| Cocamidopropyl betaine | Surfactant/Cleaning/Foam | 0.45-0.75 |
| C8-C16 Alkyl polyglucoside | Surfactant/Cleaning/Foam | 0-0.75 |
| Citric Acid | Cleaning | 0.53-1.50 |
| Sodium Hydroxide | pH Adjuster | 0.59-0.86 |
| Sorbitan Oleate Decylglucoside Crosspolymer | Fragrance Solubilizer | 0-0.2 |
| Methyl chloro isothiazolinone; Methyl isothiazolinone | Preservative | 0.08 |
| Dye | Dye | 0.002 |
| Fragrance | Fragrance | 0.15-0.3 |

TABLE 2

| Component | Function | Weight Percent Active |
|---|---|---|
| Sodium Laureth Sulfate | Surfactant/Cleaning/Foam | 0.25-0.75 |
| C8-C16 Alkyl polyglucoside | Surfactant/Cleaning/Foam | 0.50-2.5 |
| Citric Acid | Cleaning | 0.50-2.50 |
| Sodium Hydroxide | pH Adjuster | 0.40-0.86 |
| Glycerin | Solubilizer | 0-2.0 |
| Methyl chloro isothiazolinone; Methyl isothiazolinone | Preservative | 0.05-0.20 |
| Dye | Dye | 0-0.01 |
| Fragrance | Fragrance | 0.05-0.4 |

TABLE 3

| Component | Function | Weight Percent Active |
|---|---|---|
| Sodium Hypochlorite | Oxidant | 1.0-2.80 |
| Lauryl Dimethylamine Oxide | Surfactant/Cleaning/ Foam | 0.2-0.75 |
| Sodium Silicate N | pH Adjuster | 0.0-0.20 |
| Sodium Hydroxide | pH Adjuster | 0.05-0.75 |
| Alkyl Dimethyl Benzyl Ammonium Chloride | Surfactant/Cleaning | 0.10-0.80 |
| Potassium Iodide | Stabilizer | 0.0-0.10 |
| Fragrance | Fragrance | 0.01-0.15 |

The cleaning composition may be effective at cleaning, and removing soils typically present in showers and bathtubs, such as, but not limited to soap scum, hard water stains, mildew, etc. The composition could also be used in other cleaning environments, e.g., such as kitchens, bathroom sinks, walls, etc. In a kitchen environment, the composition may be effective at cleaning and removing kitchen grease. Although described principally in the context of a shower cleaning tool, the cleaning device may be employed for personal care (e.g., delivery of a body wash), auto or other vehicle care (e.g., washing a car, tires, etc.), or in health care (e.g., delivery of an antiseptic wash or other composition to the body). Other surfaces to be cleaned may include bathroom countertops, kitchen countertops, sinks, tables, stovetops, dishes, windows, mirrors, floors, etc.

Figure 4B:
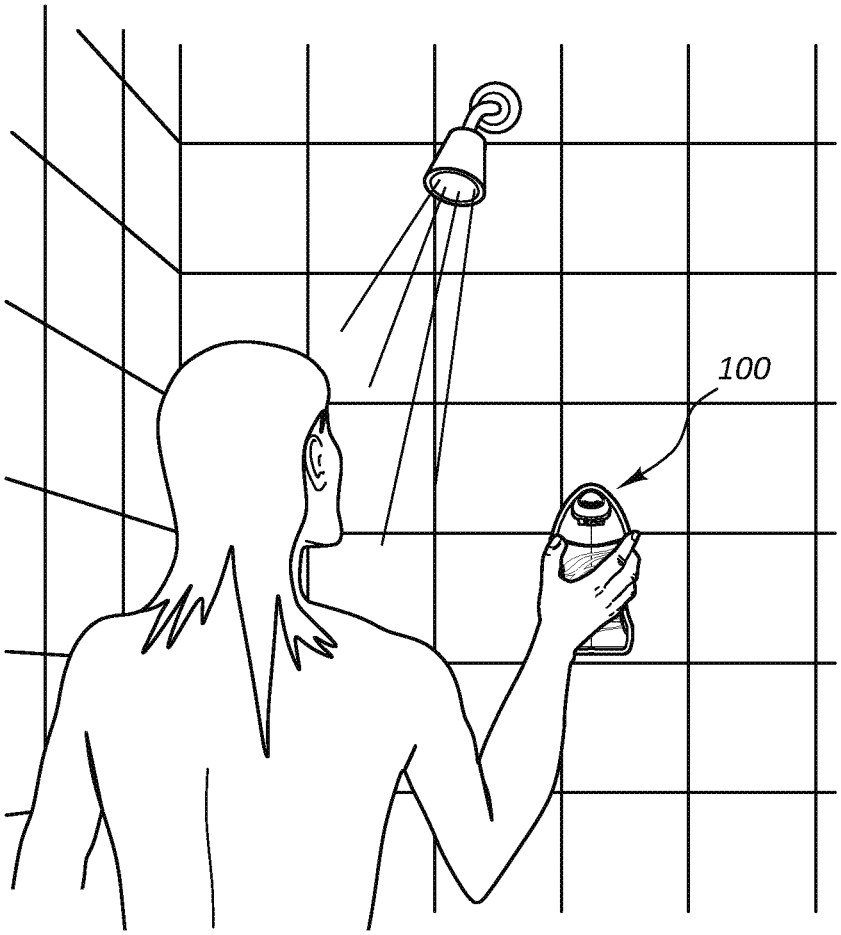

FIGS. 4A-4B illustrate how during use the direct dispensing of the liquid or gel composition onto the scrubber substrate 118 keeps the user in control of where the composition is placed, preventing or minimizing dripping or rinsing away of the composition before the surface is scrubbed clean. As shown, the device allows single handed dispensing and scrubbing operation. The substrate 118 may advantageously be attached over the device where the cleaning composition 106 is dispensed into substrate 118. Direct dispensing of composition 106 into substrate 118 significantly reduces formation of aerosolized particles of the cleaning composition, making the cleaning device more suitable for cleaning of the shower or bathtub in the flow of the shower or bath water. In addition, direct dispensing also reduces and/or eliminates overspray and allows for the user to better control which areas are being contacted and cleaned. Furthermore, direct dispensing into the substrate, rather than generation of significant aerosol is important in reducing the potential for eye irritation.

Such a cleaning method may be performed immediately before, immediately after, or during showering. For example, such cleaning may be performed after showering, before the user exits the shower, dresses, and perhaps even before drying off. Such cleaning before showering may be performed after the user has undressed and stepped into the shower, but the user may choose to clean the shower before himself or herself. In such before the shower cleaning, the shower water may typically be running, with the user in the shower. Of course, the method may also be performed in the flow of shower water, as the user showers. In any case, the user may scrub the desired surfaces, and then rinse the surface (e.g., with shower water).

In an embodiment, the volume of the metered dose dispensed upon a single actuation of the actuator 108 may be from about 0.3 cc to about 1 cc, or from about 0.4 to about 0.8 cc (e.g., about 0.6 cc). The container housing and reservoir may be sized to hold about 8 fl oz to about 12 fl. oz (e.g., about 10 fl oz) of the cleaning composition, which may be sufficient for about 500 metered doses. Such an amount may be sufficient for about 30 uses, of about 15 or 16 doses per shower cleaning use. For example, the cleaning device may be provided prefilled, ready to use, as an all-in-one cleaning tool. Such configuration may not be refillable, to be used for about 30 uses, and then disposed of (e.g., a use of once per day would last about 1 month, a use of once a week would last about 6 months, etc.).

As described above, the substrate 118 and or composition 106 may include an antimicrobial agent therein. Such may aid in sanitizing or disinfecting the surfaces being cleaned. In an embodiment, substrate 118 may include silver ions disposed therein, which silver ions provide an antimicrobial effect. Other antimicrobials may that could be provided in the substrate and/or the cleaning composition may include hypochlorite, quaternary amines, biguanides (e.g., triclosan), etc. The inclusion of such an antimicrobial agent in the substrate may allow the cleaning device to clean and sanitize or disinfect the cleaned surfaces for that period of time it is used (e.g., over a period of about 30 uses). Once all the cleaning composition has been dispensed, the cleaning device may be disposed of.

FIGS. 6A-8 illustrate additional cleaning devices, which may include a hook provided on the container housing, to assist in attaching the substrate over the scrubbing side of the container housing. Of course, any of the above described embodiments could include such a hook, or other features as described in the embodiments below, as desired.

FIGS. 6A-8 show an exemplary cleaning device 200 including a container housing 202 (e.g., shown as including a lower housing portion 202*a* and an upper shroud portion 202*b*) which includes a reservoir 204 for holding a cleaning composition 106. Composition 106 may be preloaded within the reservoir 204 of container housing 202, e.g., during manufacture. Cleaning composition 106 may be any of those described above, elsewhere herein, or others that will be apparent to one of skill in the art.

Cleaning device 200 may include an actuator (e.g., a push button) 208 and a pump assembly 210, which may be similar to actuators 108 and pump assembly 110, described above. A wall of container housing 202 may include a dispensing orifice 216 formed therein, to allow dispensing of cleaning composition 106 therethrough. For example, pressing actuator 108 may cause composition 106 within reservoir 104 to be drawn up into pump assembly 210, and dispensed through dispensing orifice 216. A break-away locking tab 232 may be provided which is configured to be broken away when it is desired to actually use the cleaning device 200 by dispensing cleaning composition 106 using actuator 208. Such a tab 232 may prevent inadvertent actuation of actuator 208 during shipment, storage, and the like.

Cleaning device 200 is shown as including a substrate 218 (e.g., a nonwoven, woven, sponge, foam, and/or cellulose material) that may be configured as a scrubbing pad, attached to the scrubbing side of cleaning device 200. For example, substrate 218 could be attached to wall 220 which defines the scrubbing side of the cleaning device 200, as shown, using hook 234. For example, as seen in FIGS. 6B-6C, 7, and 8, the lower end of substrate 218 may include a narrowed tab 218*a* extending therefrom. As shown, tab 218*a* may include a hole or slit 219 formed therein which allows hook 234 to be received into hole or slit 219 of tab 218*a*. The terms hole and slit may be used interchangeably herein. Using such a tab and slit, hook 234 may serve to attach the lower end of the substrate 218 to wall 220 (i.e., over the scrubbing surface of container housing 202).

Another portion of the substrate 218 may be attached to wall 220 by a hook and loop attachment structure. For example, as perhaps best seen in FIG. 6B, the hook portion 238 of a hook and loop attachment structure may be integrally molded or otherwise provided in or attached to wall 220. In the illustrated embodiment, hook portion 238 is shown as a plurality of micro hook structures that may be injection molded so as to extend from wall 220, e.g., formed at a top portion of wall 220. Substrate 218 (e.g., a nonwoven) may itself have a texture allowing it to serve as the loop portion of the hook and loop attachment structure, so that the top end of substrate 218 may be attached to the container housing at wall 220, using hook portion 238. In other words, the substrate 218 itself (e.g., a non-woven, "scrubby" substrate) may adhere to the hook portion 238 of the hook and loop attachment structure. Such an attachment structure advantageously does not require or rely on the need for an adhesive, but relies on a mechanical attachment between the substrate 218 and wall 220. In addition, such an attachment does not require any intermediate components disposed between wall 220 and substrate 218, but may provide for direct attachment of substrate 218 over wall 220. Attachment without use of any adhesive is particularly helpful where the cleaning device may be stored in a relatively humid environment (e.g., such as a shower), as many adhesives tend to degrade under such conditions, which could cause the substrate to peel away from the wall 220 of container housing 202.

While a hook and loop attachment structure may be provided as shown, with the hook portion 238 of the attachment structure molded with the wall 220, it will be appreciated that in other embodiments, if desired, a separate hook portion could be provided, which could be attached to wall 220 by any suitable mechanism (e.g., including an adhesive, if desired). That said, the above described embodiment in which the hook portion 238 may be injection molded as part of the wall 220 (e.g., all injection molded with upper shroud portion 202*b* or other portion of container housing 202 as a single piece) allows at least a portion of container housing 202 (e.g., upper shroud portion 202*b* or at least a portion of wall 220) and hook portion 238 to all be molded as a single integral piece, rather than providing the micro hooks of hook portion 238 separate from wall 220.

Figure 6A:
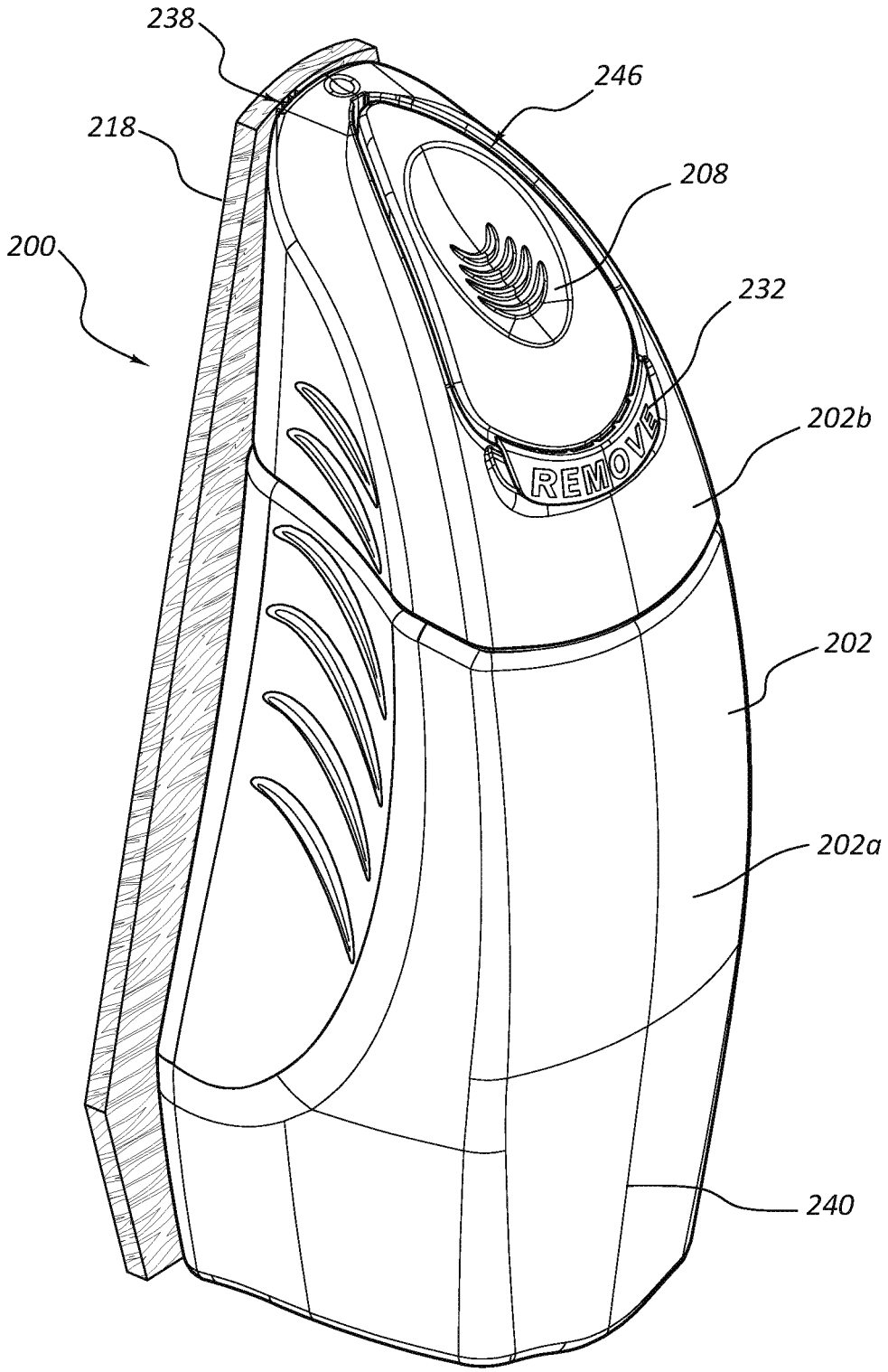
FIG. 6A is a front perspective view of another exemplary cleaning device, that may include a hook on the container housing for attachment of a substrate over the scrubbing side thereof.
Figure 6B:
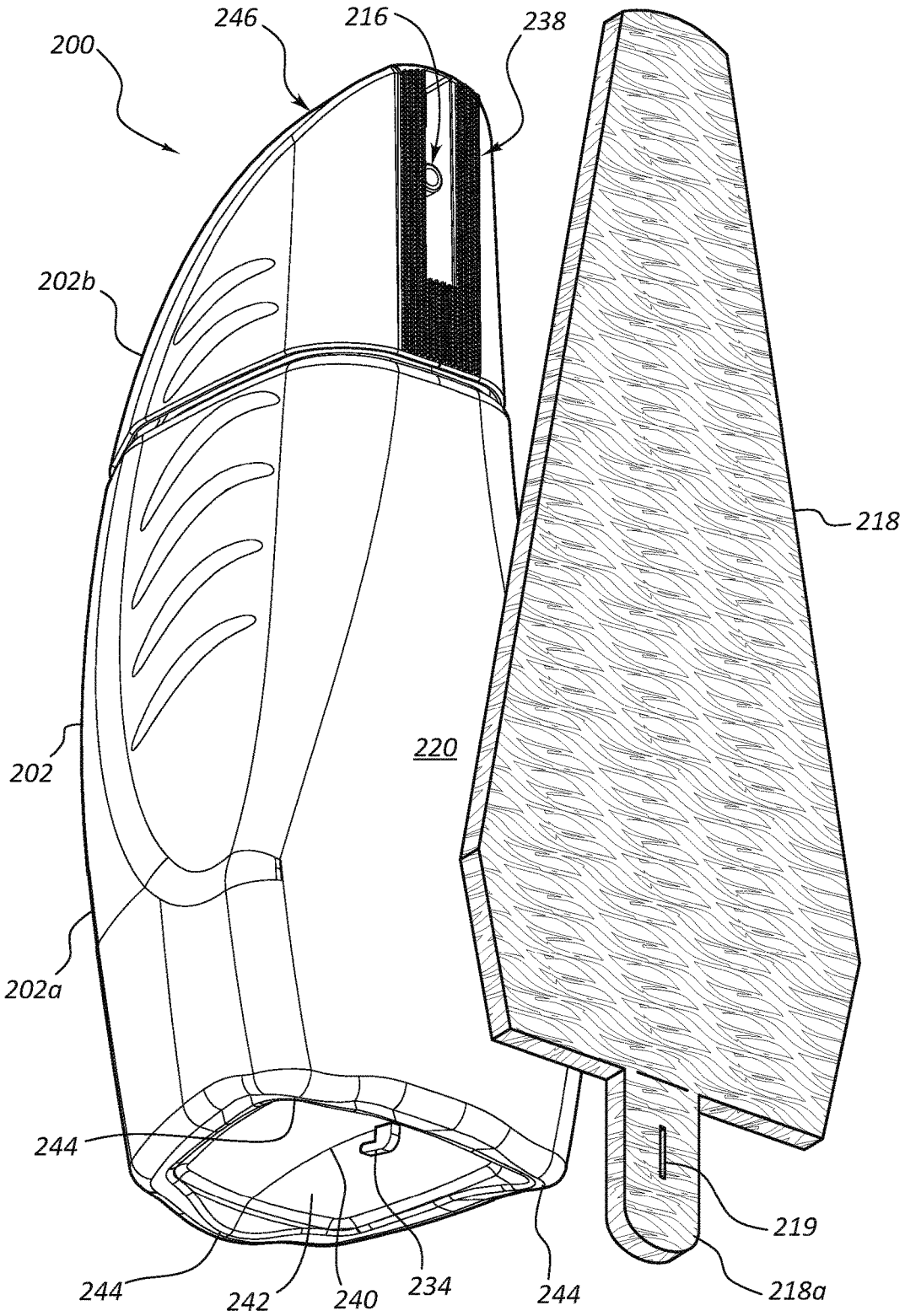
FIG. 6B is a rear perspective view of the cleaning device of FIG. 6A, with the substrate exploded away from the wall defining the scrubbing side of the cleaning device, to better show the structures on such wall.
Figure 6C:
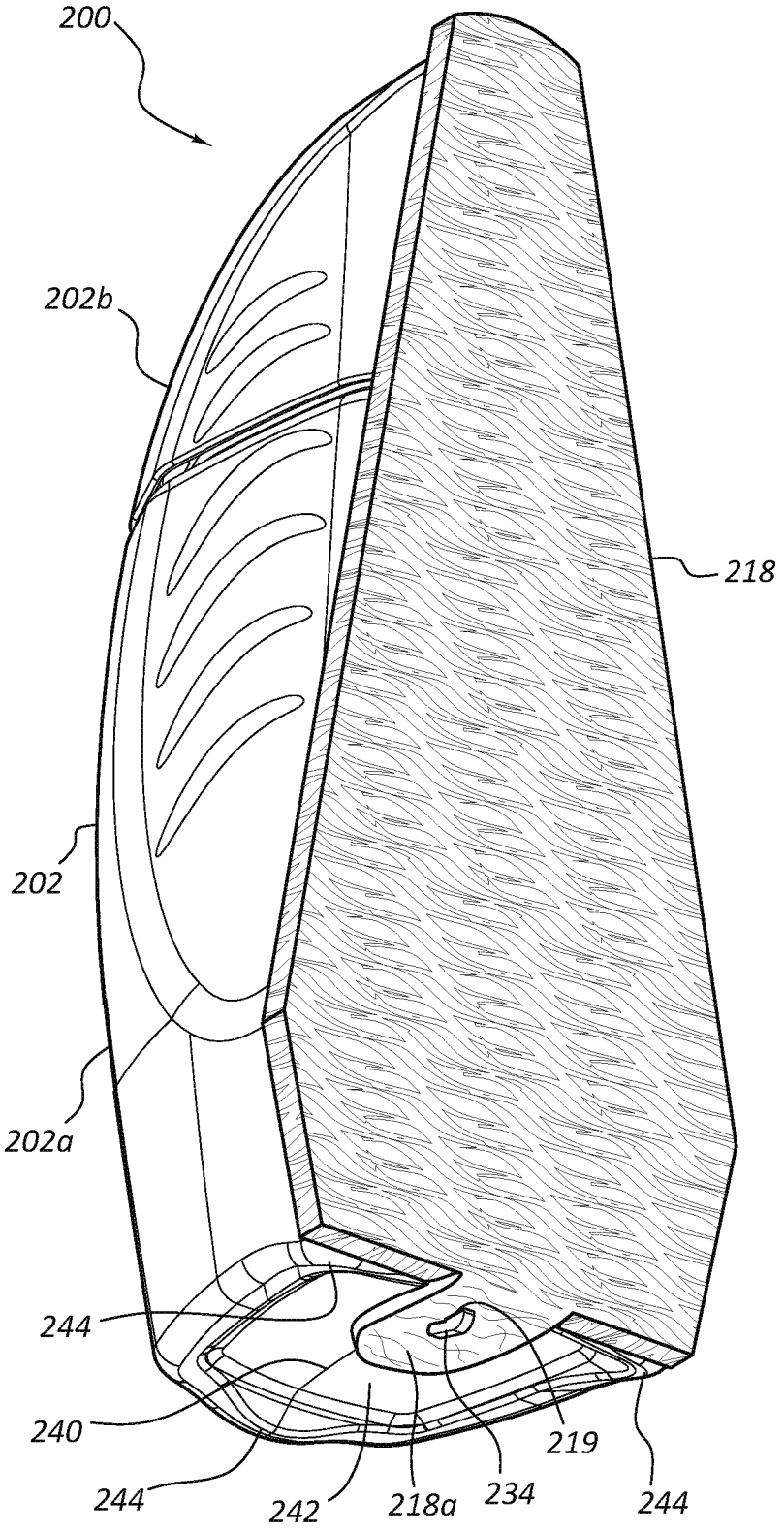
FIGS. 6C-6D are bottom and top perspective views, respectively, of the cleaning device of FIG. 6A.
Figure 6D:
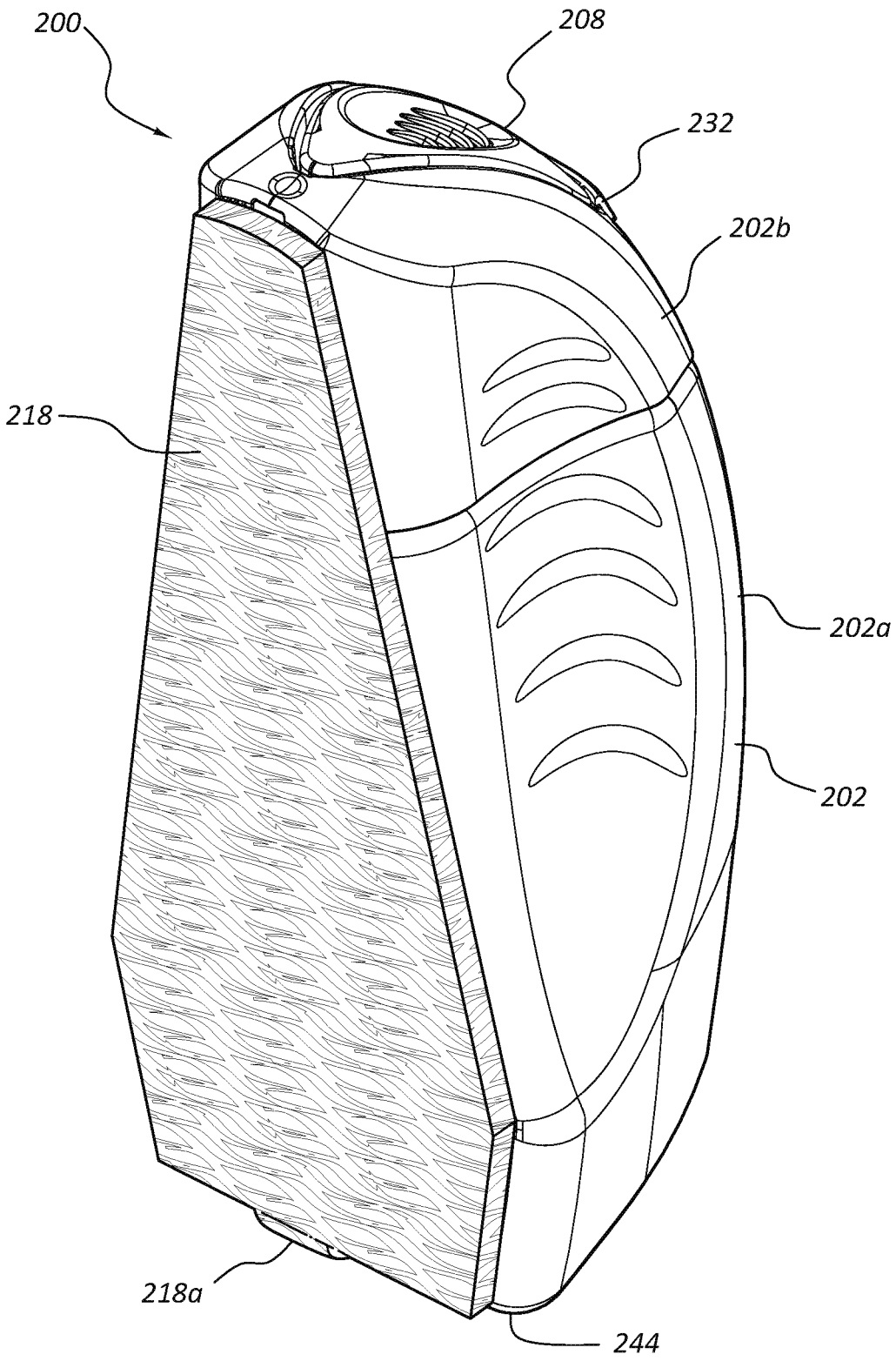
Figure 7:
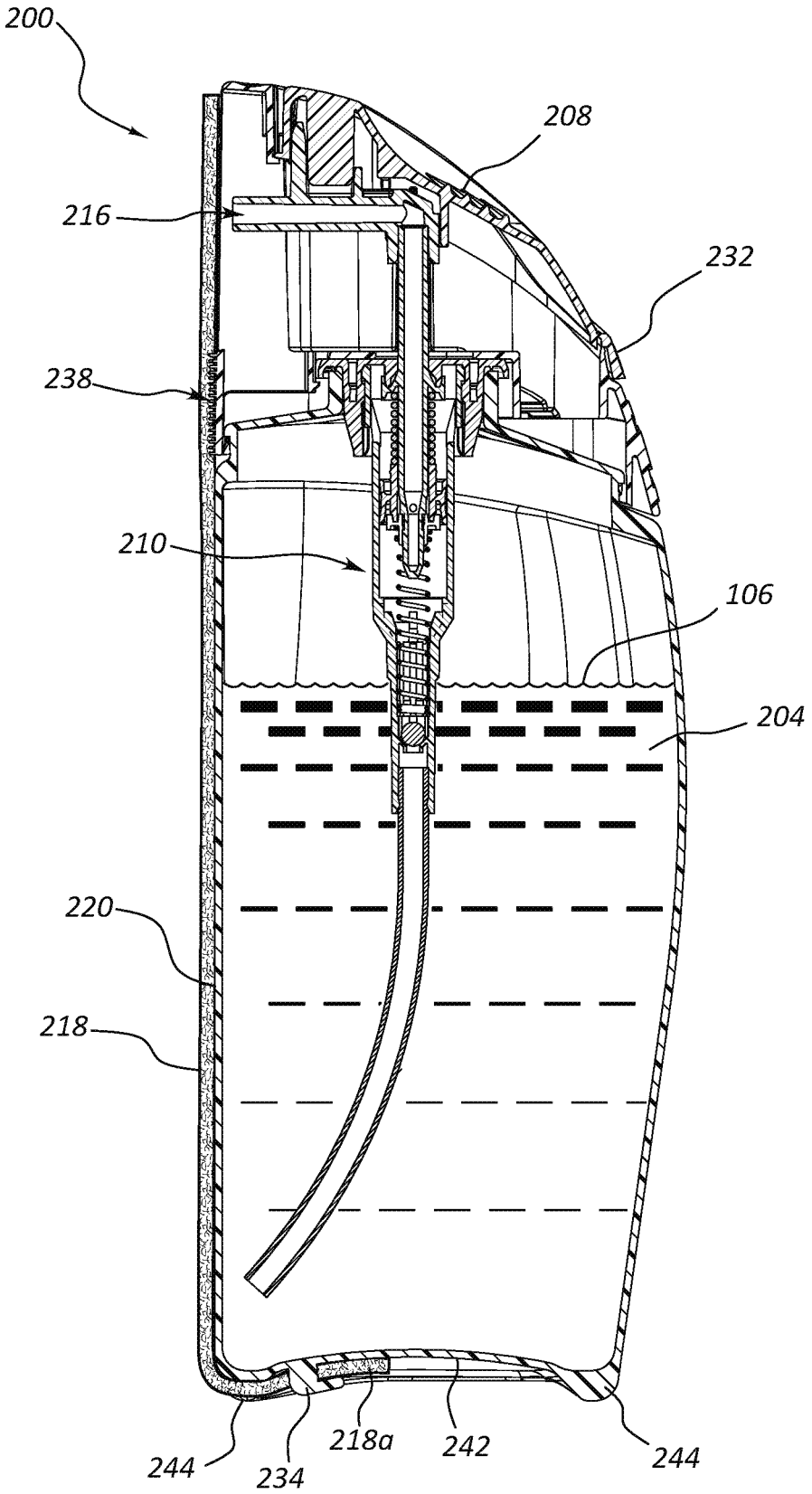
FIG. 7 is a cross-sectional view through the cleaning device of FIG. 6A.
Figure 8:
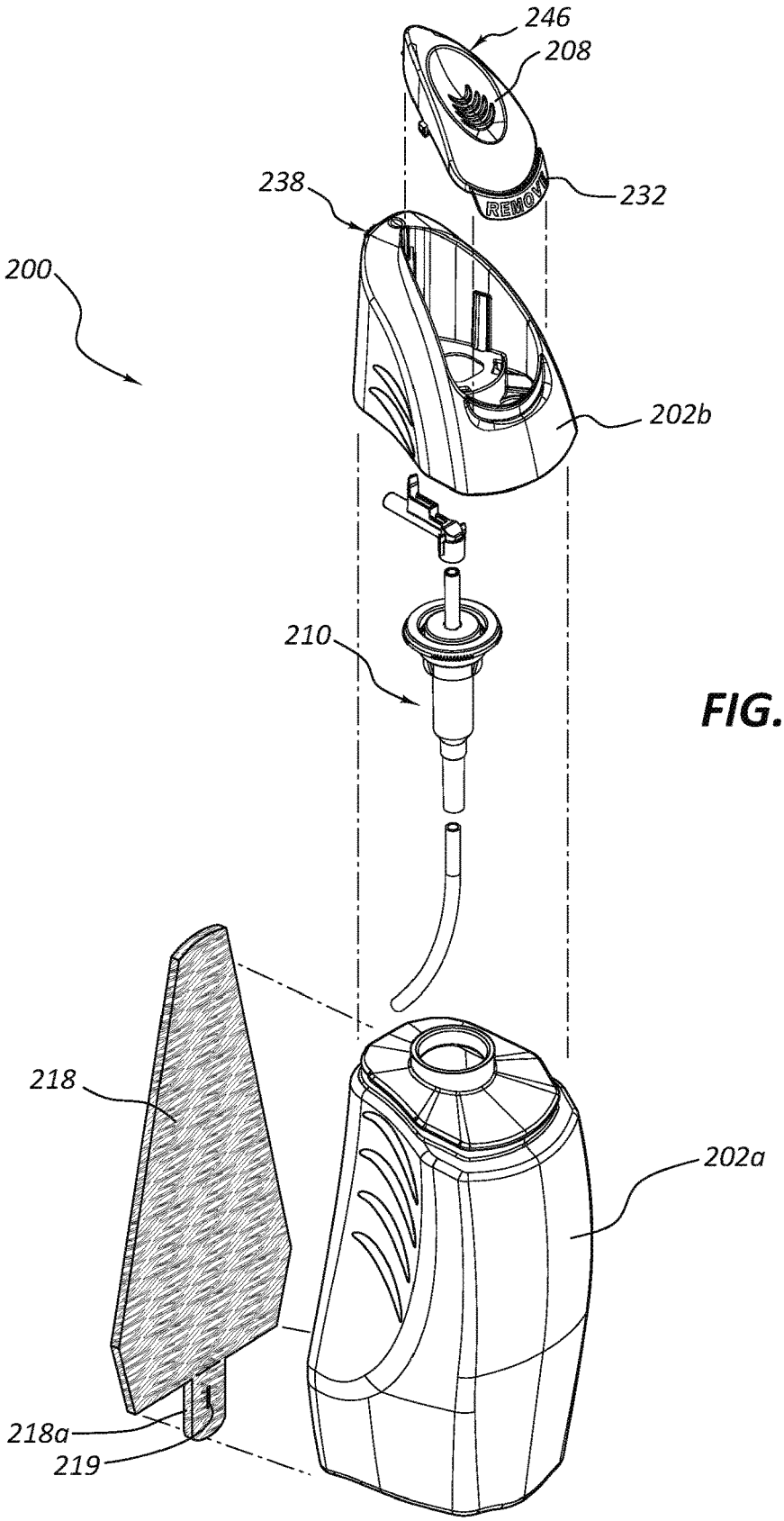
FIG. 8 is an exploded view of the cleaning device of FIG. 6A.

In a similar manner, hook 234 at the lower end of container housing 202 may similarly be injection molded with the container housing as a single piece (i.e., hook 234 being a single piece with at least lower portion 202*a* of container housing 202, rather than a separate hook that is attached thereto). Of course, other embodiments (e.g., providing a separate hook 234) are also possible. FIGS. 6B-6C and FIG. 7 perhaps best illustrate such a hook 234. In an embodiment, hook 234 may extend from container housing 202 (e.g., from lower portion 202*a*), with hook 234 positioned at a parting line 240 of container housing 202. Such positioning of hook 234 may position the hook 234 in a flash pocket associated with injection molded lower portion 202*a* of container housing 202. Such positioning allows flash material, which is typically otherwise wasted, to be used in formation of hook 234. Such positioning also allows the hook 234 and container housing 202 (one or both of lower portion 202*a* and upper shroud portion 202*b*) to be formed by injection molding, allowing hook 234 to be a single piece of material with the portion of container housing 202 that it is injection molded with (e.g., lower portion 202*a*). For example, the mold from which lower portion 202*a* is formed may include space for formation of hook 234 at parting line 240, so that as the mold is opened, and the portion of container housing 202 (e.g., lower portion 202*a*) including hook 234 is removed from the mold, the hook 234 and that portion of container housing 202 (lower portion 202*a*) to which hook 234 is attached are formed of a single piece of material.

As shown in FIG. 6B, hook 234 may be positioned on a sidewall 242 of container housing 202 (e.g., of lower housing portion 202*a*). Sidewall 242 may be adjacent to wall 220. For example, as will be apparent from the Figures, when wall 220 is oriented so as to be generally vertical, sidewall 242 is oriented to be a bottom wall of the container housing 202 of cleaning device 200. Furthermore, bottom wall 242 may be concavely curved, as seen in FIG. 7, with hook 234 extending from bottom wall 242. Bottom wall 242 is also shown as further including a plurality of feet 244 that extend from bottom wall 242. Feet 244 in conjunction with concave curvature of wall 242 allow hook 234 to be recessed relative to the feet 244, as seen in FIG. 7.

This configuration allows cleaning device 200 to be stood upright, supported on feet 244, without interference from hook 234 (e.g., without hook 234 striking a generally horizontal surface on which feet 244 may be supported). Because substrate 218 is attached to hook 234 by narrow tab 218*a*, rather than a full width of the substrate 218, the tab 218*a* is able to fit between two of adjacent feet 244, and engage with hook 234, also without interfering with the ability of feet 244 to support cleaning device 200 on a generally horizontal surface (e.g., corner of a bathtub, shower stall, countertop, table top, or the like, similar to as seen in FIG. 5A).

Hook 234 may be fixed and/or rigid. For example, hook 234 may remain in place, allowing it to engage with slit 219 or substrate 218, rather than being readily bendable or retractable. Rigidity of hook 234 may aid hook 234 is effectively holding the lower end of tab 218*a* in place, to assist in securing substrate 218 over wall 220 of container housing 202. Of course, other embodiments are also possible.

Cleaning device 200 may include an angled front nose 246, so that front nose 246 is reduced in width as compared to regions posterior to the angled front nose 246. This allows the front nose 246 to more easily reach into hard to reach areas being cleaned (e.g., into corners, between faucet fixtures and a wall or countertop, and the like).

While substrate 218 is shown as extending over dispensing orifice 216, it will be appreciated that substrate 218 may optionally include a cut-out surrounding or otherwise adjacent to such dispensing orifice, as desired. Where a cut-out or similar (not shown) is provided in substrate 218, cleaning composition 106 may be squirted clear of substrate 218, allowing the user to spray or squirt the cleaning composition 106 directly onto the desired surface to be cleaned. In the illustrated embodiment, the substrate 218 may cover the dispensing orifice 216, so that the cleaning composition may be squirted, sprayed, or otherwise dispensed directly into the substrate 218, and which may then be scrubbed into the surface being cleaned.

While illustrated in the context of cleaning devices including an actuator (e.g., 108, 208) and an associated pump assembly 110, 210), it will be appreciated that other mechanisms may be employed for dispensing cleaning composition 106. For example, any of the container housings (e.g., 102, 202) could be squeezable, and a dispensing valve could be provided therewith (e.g., in wall 120, 220) that allows cleaning composition 106 to be dispensed therethrough when the container housing is squeezed.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A cleaning device comprising:

(a) a container housing including a wall defining a scrubbing side and a reservoir for holding a cleaning composition, the wall defining the scrubbing side including a dispensing orifice through which the cleaning composition may be selectively dispensed;

(b) a hook extending from the container housing which hook is engageable with a substrate configured as a scrubbing pad so that the hook assists in holding the substrate against the wall defining the scrubbing side of the container housing;

(c) a substrate configured as a scrubbing pad positioned over the wall defining the scrubbing side of the container housing, the substrate being disposed over or about the dispensing orifice so that the cleaning composition may be dispensed from the reservoir, through the dispensing orifice and wherein one end of the substrate is attached by the hook over the wall defining the scrubbing surface, and an opposite end of the substrate is attached to the wall of the container housing by a hook and loop attachment structure.

2. The cleaning device of claim 1, further comprising:

(d) an actuator disposed on the container housing; and (e) a pump assembly at least partially disposed within the container housing and in fluid communication with the cleaning composition within the reservoir, the actuator being operably coupled to the pump assembly and configured to dispense a metered dose of the cleaning composition from the reservoir through the dispensing orifice upon actuation of the actuator.

3. The cleaning device of claim 1, wherein the wall defining the scrubbing side further comprises a hook portion of a hook and loop attachment structure for aiding in attaching the substrate over the wall of the container housing that defines the scrubbing side.

4. The cleaning device of claim 3, wherein the hook portion of the hook and loop attachment structure is integrally molded with the wall.

5. The cleaning device of claim 3, wherein the hook portion of the hook and loop attachment structure and at least a portion of the container housing are injection molded as a single piece.

6. The cleaning device of claim 1, wherein the hook extending from the container housing which is engageable with the substrate is injection molded with at least a portion of the container housing as a single piece.

7. The cleaning device of claim 6, wherein the hook extending from the container housing which is engageable with the substrate is positioned at a parting line of the injection molded container housing, so that the hook is in a flash pocket of the injection molded container housing.

8. The cleaning device of claim 1, wherein the hook is disposed on a sidewall of the container housing, adjacent the wall that defines the scrubbing side of the container housing.

9. The cleaning de-ice of claim 8, wherein the sidewall is a bottom wall when the scrubbing side of the container housing is vertically oriented, the bottom wall being concavely curved, and the container housing further comprising a plurality of feet extending from the bottom wall so that the cleaning device can be stood vertically on the plurality of feet, with the hook of (b) being recessed relative to the plurality of feet.

10. The cleaning device of claim 1, wherein the cleaning device includes an angled front nose that is reduced in width as compared to regions posterior to the angled front nose to better reach into hard to reach areas being cleaned.

11. The cleaning device of claim 1, wherein the substrate comprises a nonwoven.

12. A cleaning device comprising:

(a) a container housing including a reservoir for holding a cleaning composition and including a generally vertical wall defining a scrubbing side of the container housing with a dispensing orifice through which the cleaning composition may be selectively dispensed, the container housing further including a sidewall adjacent to the generally vertical wall that is a bottom wall when the cleaning device is oriented vertically;

(b) a hook extending from the bottom wall of the container housing, the hook being positioned at one end of the container housing, the hook being engageable with a substrate configured as a scrubbing pad to assist in holding the substrate against the generally vertical wall defining the scrubbing side of the container housing;

(c) a substrate configured as a scrubbing pad positioned over the wall defining the scrubbing side of the container housing, the substrate being disposed over or about the dispensing orifice so that the cleaning composition may be dispensed from the reservoir, through the dispensing orifice; and (d) a hook portion of a hook and loop attachment structure integrally molded into the generally vertical wall of the container housing that defines the scrubbing side of the container housing, the hook portion of the hook and loop attachment structure being positioned at an end of the container housing opposite the hook of (b) so that a lower end of the substrate is attached to the container housing at the hook of (b) and a top end of the substrate is attached to the container housing at the hook portion of the hook and loop attachment structure.

13. The cleaning device of claim 12, further comprising:

(e) an actuator disposed on the container housing; and (f) a pump assembly at least partially disposed within the container housing and in fluid communication with the cleaning composition within the reservoir, the actuator being operably coupled to the pump assembly and configured to dispense a metered dose of the cleaning composition from the reservoir through the dispensing orifice upon actuation of the actuator.

14. The cleaning device of claim 12, wherein the hook extending from the bottom wall of the container housing, which hook is engageable with the substrate, is injection molded with the bottom wall as a single piece.

15. The cleaning device of claim 14, wherein the hook extending from the bottom wall of the container housing, which hook is engageable with the substrate, is positioned at a parting line of the injection molded container housing, so that the hook is in a flash pocket of the injection molded container housing.

16. The cleaning device of claim 12, wherein the bottom wall of the container housing on which the hook of (b) is disposed is concavely curved, the container housing further comprising a plurality of feet extending from the bottom wall of the container housing, the hook extending from the bottom wall being recessed relative to the plurality of feet so that the cleaning device can be stood vertically on the plurality of feet.

17. The cleaning device of claim 12, wherein the substrate comprises a nonwoven.

18. A cleaning device comprising:

(a) a container housing including a reservoir for holding a cleaning composition and including a generally vertical wall defining a scrubbing side of the container housing with a dispensing orifice through which the cleaning composition may be selectively dispensed, the container housing further including a sidewall adjacent to the generally vertical wall that is a bottom wall when the cleaning device is oriented vertically;

(b) a hook extending from the bottom wall of the container housing, the hook being engageable with a slit formed in a tab of a substrate to assist in holding the substrate against the generally vertical wall defining the scrubbing side of the container housing;

(c) a nonwoven substrate configured as a scrubbing pad positioned over the generally vertical wall defining the scrubbing side of the container housing, the substrate being disposed over or about the dispensing orifice so that the cleaning composition may be dispensed from the reservoir, through the dispensing orifice, into the substrate, the substrate including the tab at a lower end thereof, with the slit formed through the tab for engagement with the hook; and (d) a hook portion of a hook and loop attachment structure integrally molded into the generally vertical wall of the container housing that defines the scrubbing side of the container housing, the hook portion of the hook and loop attachment structure being positioned at a top end of the container housing so that a lower end of the substrate is attached to the container housing by the hook of (b) and a top end of the substrate is attached to the container housing by the hook portion of the hook and loop attachment structure.

19. The cleaning device of claim 18, wherein the bottom wall of the container housing on which the hook of (b) is disposed is concavely curved, the container housing further comprising a plurality of feet extending from the bottom wall of the container housing, the hook extending from the bottom wall being recessed relative to the plurality of feet so that the cleaning device can be stood vertically on the plurality of feet.

* * * * *